United States Patent [19]

Takano et al.

[11] Patent Number: 5,049,092

[45] Date of Patent: Sep. 17, 1991

[54] A CONNECTOR ASSEMBLY FOR ELECTRICAL COMPONENTS

[75] Inventors: T. Takano; K. Shinzawa, both of Tokyo, Japan

[73] Assignee: Daiichi Denso Buhin Co., Ltd., Tokyo, Japan

[21] Appl. No.: 550,854

[22] Filed: Jul. 10, 1990

[30] Foreign Application Priority Data

| | | | |
|---|---|---|---|
| Jul. 21, 1989 | [JP] | Japan | 1-85914[U] |
| Jul. 21, 1989 | [JP] | Japan | 1-85915[U] |
| Aug. 8, 1989 | [JP] | Japan | 1-93176[U] |
| Aug. 8, 1989 | [JP] | Japan | 1-93177[U] |
| Aug. 8, 1989 | [JP] | Japan | 1-93178[U] |
| Aug. 10, 1989 | [JP] | Japan | 1-94036[U] |
| Aug. 10, 1989 | [JP] | Japan | 1-94037[U] |
| Aug. 10, 1989 | [JP] | Japan | 1-94038[U] |
| Sep. 12, 1989 | [JP] | Japan | 1-106881[U] |
| Sep. 12, 1989 | [JP] | Japan | 1-106882[U] |

[51] Int. Cl.[5] ..... H01R 13/74

[52] U.S. Cl. ..... 439/540; 439/553; 439/621

[58] Field of Search ..... 439/552, 553, 554, 555, 439/562, 565, 621, 540

[56] References Cited

U.S. PATENT DOCUMENTS

| | | | |
|---|---|---|---|
| 4,220,391 | 9/1980 | Kralak et al. | 439/540 |
| 4,883,432 | 11/1989 | Reed | 439/553 |
| 4,887,978 | 12/1989 | Murakami | 439/553 |

FOREIGN PATENT DOCUMENTS

| | | |
|---|---|---|
| 50-36658 | 10/1975 | Japan . |
| 678012 | 8/1952 | United Kingdom . |
| 963825 | 7/1964 | United Kingdom . |
| 964062 | 7/1964 | United Kingdom . |
| 1011997 | 12/1965 | United Kingdom . |
| 1101637 | 1/1968 | United Kingdom . |
| 2106722 | 4/1983 | United Kingdom . |
| 2165102 | 4/1986 | United Kingdom . |
| 2194395 | 3/1988 | United Kingdom . |

*Primary Examiner*—Gary F. Paumen

*Attorney, Agent, or Firm*—Nixon & Vanderhye

[57] ABSTRACT

Connector assemblies for mounting electrical components and for establishing electrical connection with the same are provided with a support base which defines an engaging hole to accept a connector subassembly. The connector subassembly includes an electrically insulating base member, and a pair of U-shaped resilient electrical connectors which are adapted to support an electrical component as well as establish electrical communication therewith. The support base and the connector subassembly are collectively provided with structures which allow the insulating base member to be inserted into the engaging hole of the support base to achieve a coupled position and such that, upon reaching this coupled position, the insulating base member is coupled to the support base.

4 Claims, 25 Drawing Sheets

CONNECTOR ASSEMBLY FOR ELECTRICAL COMPONENTS

BACKGROUND OF THE INVENTION

1. Field of the Invention

The present invention generally relates to connector assemblies for electrical components. More specifically, the invention relates to connector assemblies having a pair of connectors which are suitable for establishing electrical connection between elongate straight lamps, glass fuses and the like and an external electrical circuit via a terminal portion of an electrical lead.

2. Description of the Related Art

An example of a conventional connector assembly is disclosed in Japanese Utility Model Publication No. 50-36658, which discloses a fuse box having a resilient metal strip (a good conductor) bent into the shape of the letter "U" when viewed cross-sectionally. In addition, a pair of open slots are formed in both sides of the strip. Fuse holders, which are provided with tapered surfaces that inwardly incline are provided at both ends of the metal strip and are in the shape of a circular arc for clamping respective ends of a cylindrical fuse therebetween.

Coupling projections, equipped with a pair of locking concave members that are located in opposition to the slots of the holders, are provided on the edge of the fuse holder attachment member of the fuse box body. Moreover, a fuse box made of insulating material is provided with a plurality of pairs of square through-holes so as to allow mounting of the holders from beneath the surface of the fuse box.

Coupling projections, equipped with locking concave members, are provided on the edge of the attachment member containing the through-holes of the fuse box body. By providing slots that engage these projections on the side of the fuse holders, one side of the slots engages the locking concave members of the coupling projections resulting in coupling therebetween which allows attachment and removal of the fuse holders.

In the prior art described above, the fuse or straight lamp holders are typically connected to another conducting member, lead wires, etc. via the fuse holders by means of soldering, or by means of caulking band-shaped conducting strips having a small width, commonly referred to as BUS bars. Thus, in the case of this prior art structure, the use of connecting tools, such as a soldering iron or caulking tool, is required. As a result, connection is typically not possible in confined, dark locations (such as inside an automobile engine compartment).

In addition, in order to install the fuse or straight lamp holders on conducting metal plates (such as those of the automobile body and chassis), it is necessary to place special insulating bushings between each of the fuse or straight lamp holders thus making installation both cumbersome and laborious. Moreover, since the contact members of the fuse or straight lamp holders generate heat due to the flow of current, the entire fuse box is required to be made of expensive, heat-resistant plastic, such as 66 nylon.

SUMMARY OF THE INVENTION

Accordingly, one object of the present invention is to allow other conducting members to be easily and reliably connected to a clamping socket type connector without the use of connecting tools. In addition, an object of this invention is to allow the assembled component of the connector to be attached with favorable compatibility at any location without regard to the electrical conductivity of the members to which it is attached.

In the case of installing a large number of straight lamps or fuses in a confined area, the present invention allows an insulating base having a pair of connectors to be fit onto an attaching member with a single, simple manipulation. Since the bases of the locking tabs formed on the insulating base (which comprises the connector assembly) are fabricated as a single unit, they have a high level of mechanical strength and do not move indiscriminately after being engaged with the attaching member.

Each connector of the present invention includes an integral U-shaped clamp and a plug-in receptacle. As a result, straight lamps or glass fuses can be securely clamped between a pair of such clamps and a tab terminal or BUS bar can be securely inserted directly into the respective plug-in receptacle so as to electrically connect the lamp/fuse to a desired electrical circuit.

The attachment assembly of the connector (in other words, the connector assembly component) is surrounded by an insulating base. Thus, two connectors can be mounted through this base with favorable compatibility regardless of its mounting on conducting or insulating plates.

In addition, connectors of the type in which locking tabs of the insulating base are pushed into the edges of the engaging hole of the attaching member at an inclination against the resilient force of the insulating base, can be mounted easily in the manner of a so-called "cassette locking mechanism". That is, the locking tabs "click" into place when the insulating base returns to its original form after being compressed in a direction which causes the space between the clamps to become more narrow. When in this mounted state, movement in the vertical direction of the insulating base with respect to the attaching member is restricted due to the tab edges of the locking tabs and the upper surfaces of the flanges each being in contact with the upper and lower surfaces, respectively, of the attaching member thus preventing indiscriminate movement therebetween (e.g., "rattling").

Further aspects of this invention will become more clear after consideration is given to the following detailed description of the preferred exemplary embodiments.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1A:
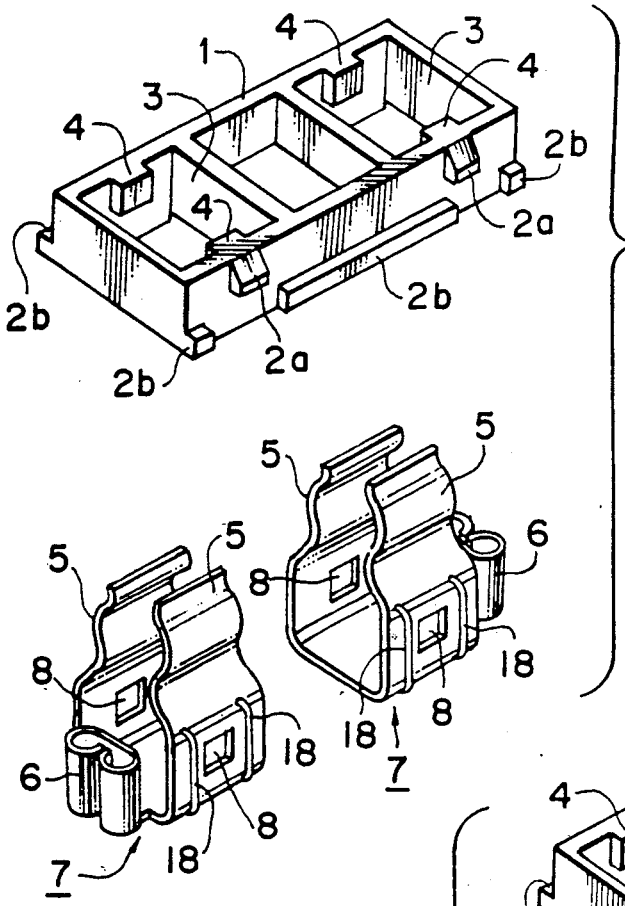
FIG. 1A and 1B are perspective views of a preferred embodiment of this invention wherein the connector and insulating base used in this invention are separated from one another.
Figure 2A:
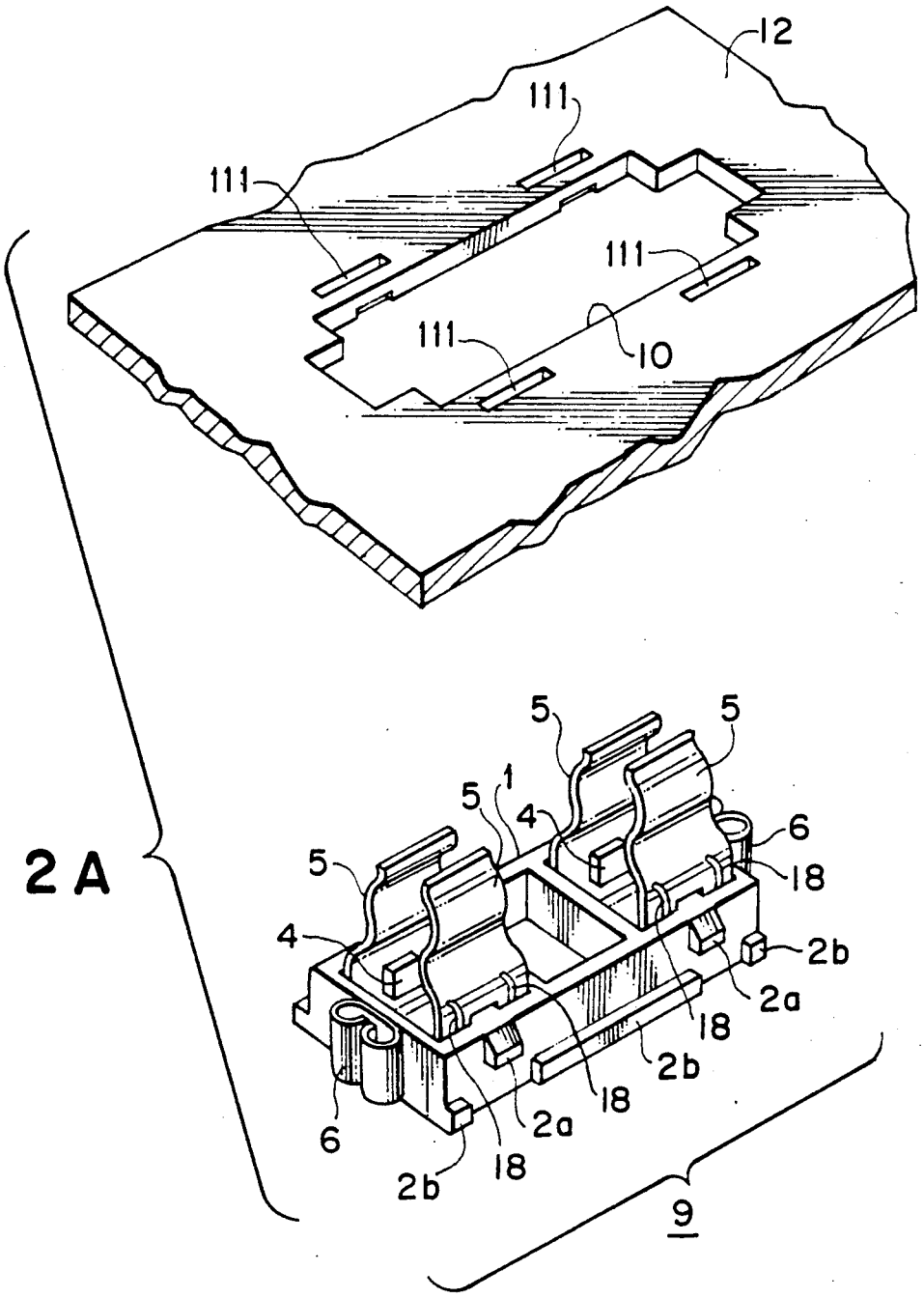
FIG. 2A through 2J are perspective views of a preferred embodiment of this invention wherein the connector assembly and attaching material are separated from one another.

The preferred embodiments of this invention will be described with reference to the drawings. Referring to FIGS. 1A and 2A, the basic construction of the first embodiment of this invention consists of a plurality of locking tabs 2*a* and flanges 2*b* projecting from the side of the insulating base 1, insulating base 1 being of heat-resistance plastic, etc. molded into the shape of a nearly rectangular frame using an insulating material. A pair of connector insertion holes 3 is formed in insulating base IA, and includes two pairs of projections 4 projecting in opposition to each other from the sides of respective insertion holes 3. A pair of clamps 5, for which resilient generally metal U-shaped strips and a plug-in receptacle 6 are formed into a single unit with one such unit being provided for each of the two connectors 7. The two connectors 7 are mounted into the pair of connector insertion holes 3. The pair of projections 4 thus extend through attachment holes 8 formed in the bases of the clamps 5, thus forming the connector assembly 9 as shown in FIG. 2A. In addition to an engaging hole 10 which is slightly larger than the flat peripheral contour of the insulating base 1, relief slots 111 are formed at respective locations in opposition to each of the locking tabs 2*a* so as to form the attaching member 12 as shown in FIG. 2A.

Figure 3A:
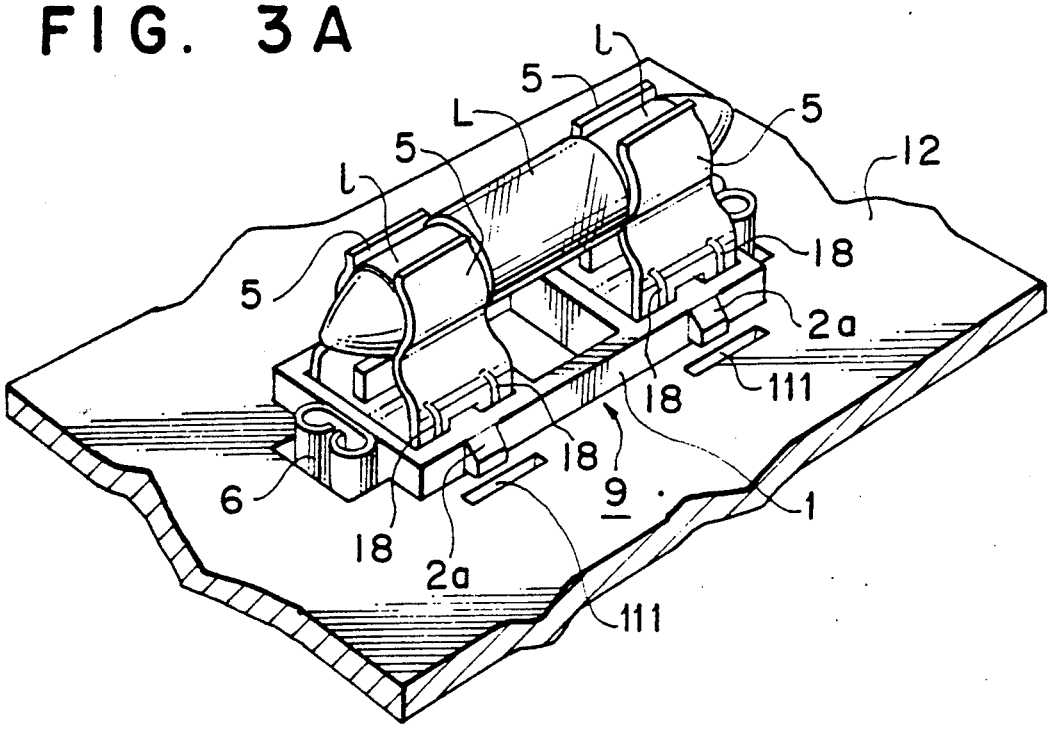
FIG. 3A through FIG. 3J are perspective views of a preferred embodiment of this invention in use following assembly of the connector assembly and attaching member.
Figure 3B:
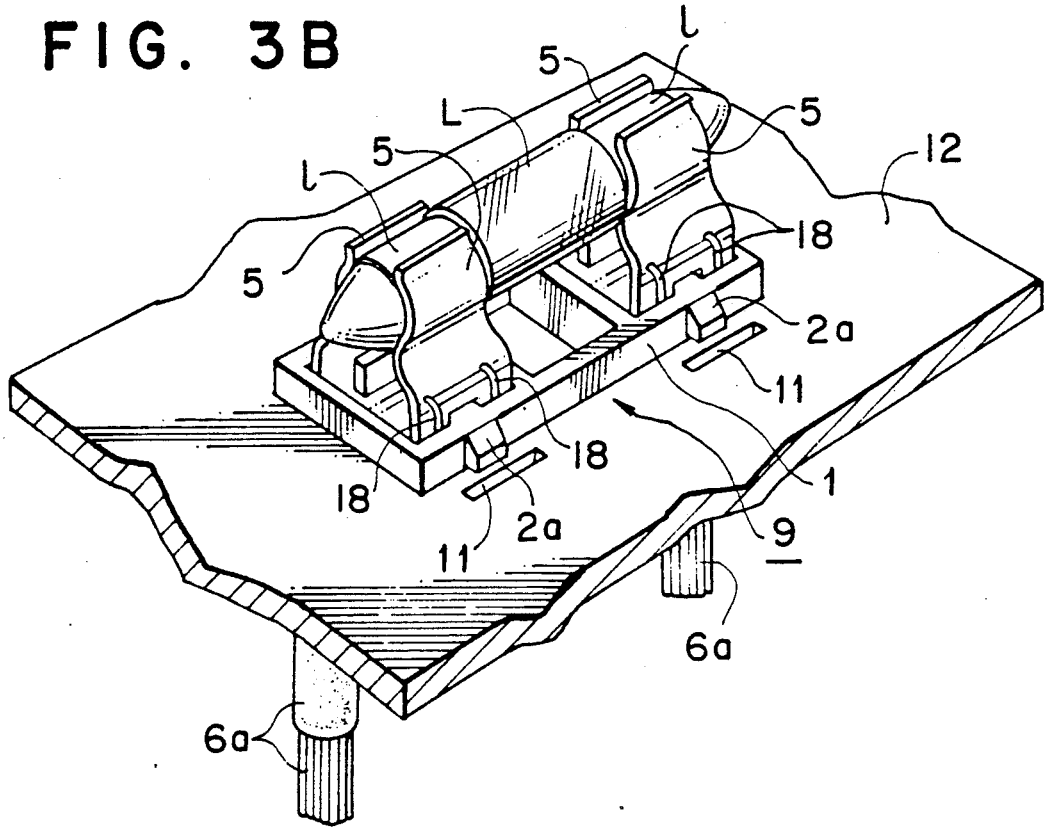
Figure 4:
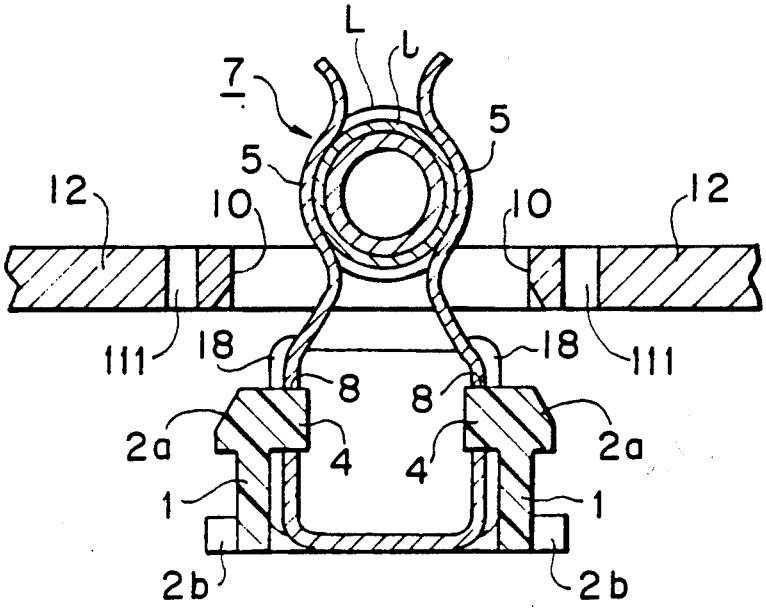
FIG. 4 through FIG. 6F are cross-sectional views depicting the procedure by which the insulating base is attached to the attaching member.
Figure 5:
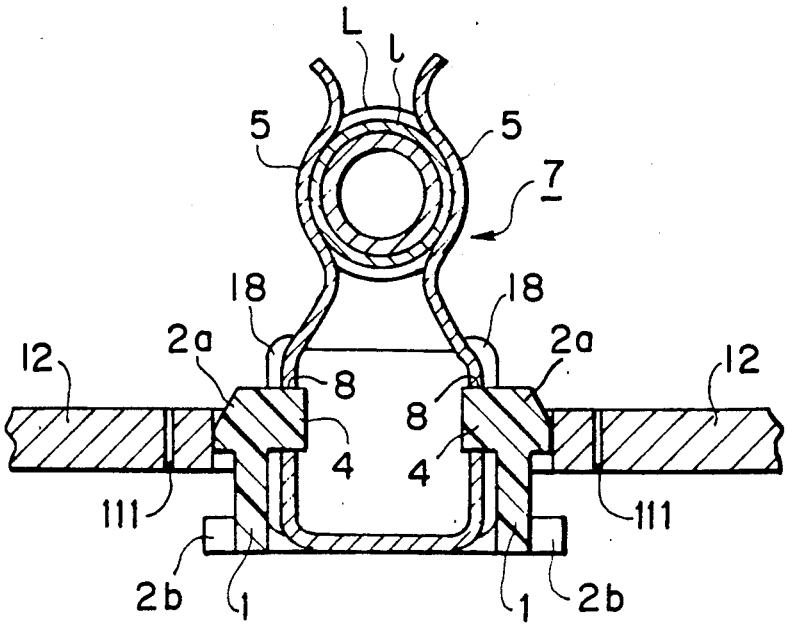
Figure 6A:
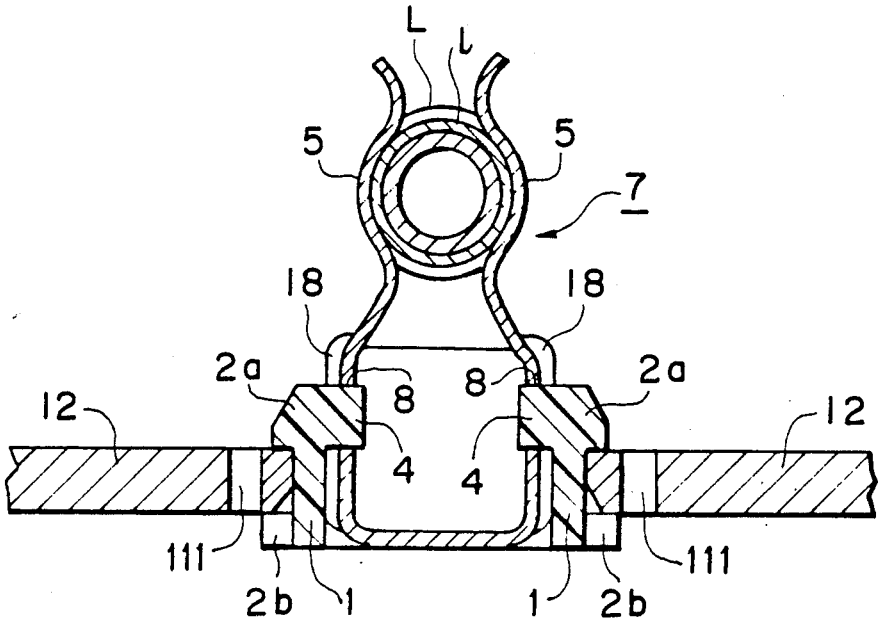
Figure 6B:
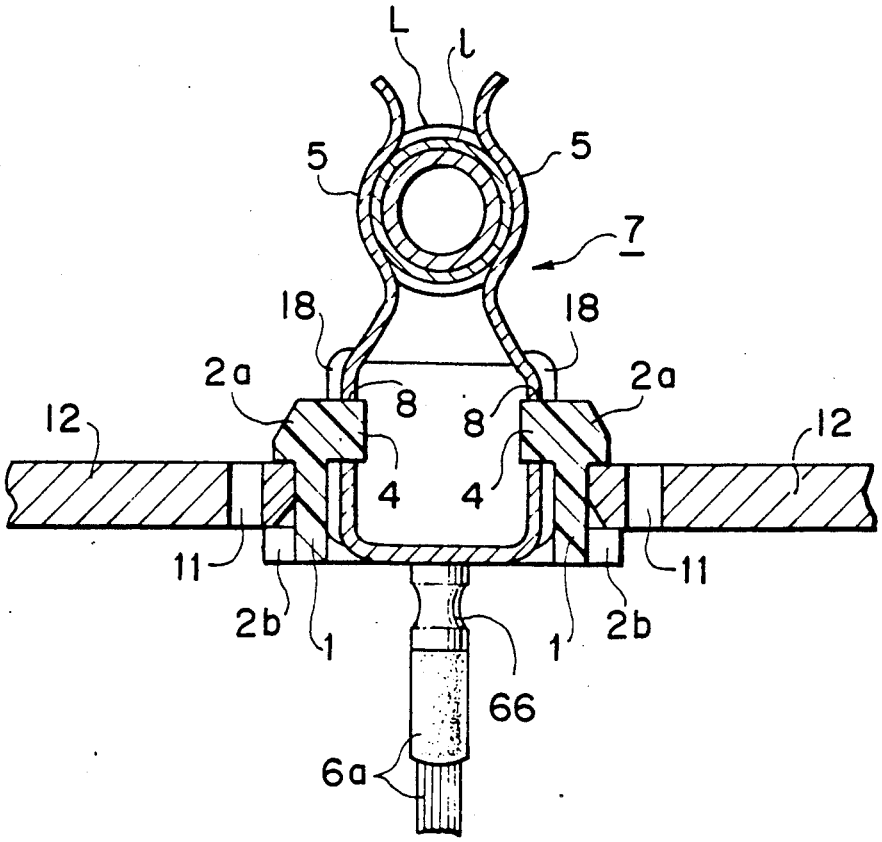

The connector assembly 9 may then be engaged with the attaching member 12 at engaging hole 10 as shown in FIGS. 3A and 6A with the locking tabs 2*a* and the flanges 2*b* in the manner as shown in FIGS. 4 and 5.

A specific example of the attaching component of the connector of this invention will now be described. In this regard, two insertion holes 3 of the two connectors 7 are formed at a specified interval in the upper surface of the insulating base 1 as shown in FIG. 1A by molding of a heat-resistant plastic such as nylon 66 or polybutylene phthalate. The insertion holes 3 extend completely through the base 1 and thus are open at the base's lower surface as is shown in FIG. 1A. A pair of projections 4 which engage with the connector 7 are provided on the inner surfaces of opposing walls of each insertion hole 3.

As shown also in FIG. 1A, conducting strips made of conductive leaf spring material such as phosphor bronze, nickel silver or beryllium copper are stamped out in the shape resembling a cross on a base. The strips are bent into a shape that generally resembles the letter "U" by forming a bottom portion between the arms of the cross and bending the arms upward to form a pair of clamps 5 which serve as the clamping receptacle members. Plug-in receptacles 6, which extend from the sides of the bottoms of clamps 5, are formed in a single plane into a shape which resembles eyeglasses and then bent parallel with the pair of clamps 5.

Raised ribs 18 are formed on the bases of the clamps 5 in order to strengthen attaching holes 8, which projections 4 of connector insertion holes 3 project through, and to obtain funneling effects for dissipation of heat by forming gaps between the inner walls of connector insertion holes 3 and said clamps 5.

Thus, as shown in FIG. 2A, connectors 7 fit inside projections 4, that are provided in opposition to each other on the opposing inner walls of connector insertion holes 3 of the insulating base 1, with a clicking action utilizing the resiliency of clamps 5 through attachment holes 8 that are formed on each of the bases of the pair of clamps 5 to form the connector assembly 9.

In addition, as shown in FIG. 2A, attaching member 12 may be made of plastic or metal sheet, having engaging hole 10 slightly larger than the flat contour of the insulating base 1, and relief slots 111 which are formed at each of the locations that are in opposition to the locking tabs 2*a*. Thus, the connector assembly 9 is inserted into engaging hole 10 of attaching member 12 and mounted in position with the locking tabs 2*a* and flanges 2*b* as shown in FIG. 3A according to the sequence shown in FIG. 4 through FIG. 6A.

More specifically, in this case, connector assembly 9 can be easily mounted in the manner of a so-called "cassette locking mechanism" with a single clicking action as a result of the edges of engaging hole 10 of attaching member 12 being pushed open in the direction in which relief slits 111 become narrower in opposition to the resiliency of attaching member 12 due to the inclination of the surfaces of locking tabs 2*a* of insulating base 1 as shown in FIG. 5.

Thus, in this mounted state the vertical movement of insulating base 1 with respect to attaching member 12 is restricted by the tab edges of locking tabs 2*a* and the upper surfaces of flanges 2*b* each being in contact with the upper and lower surfaces, respectively, of attaching member 12 thus preventing rattling. Horizontal movement of insulating base 1 is restricted by the inner edge of engaging hole 10 of attaching member 12, thus preventing rattling Furthermore, when attaching member 12 is made of metal, the portions between relief holes 111 and engaging hole 10 should be formed so that the material thickness is small. In addition, straight lamp L or connection conductors 1 such as glass fuses may be inserted between the pairs of clamps 5.

Figure 11A:
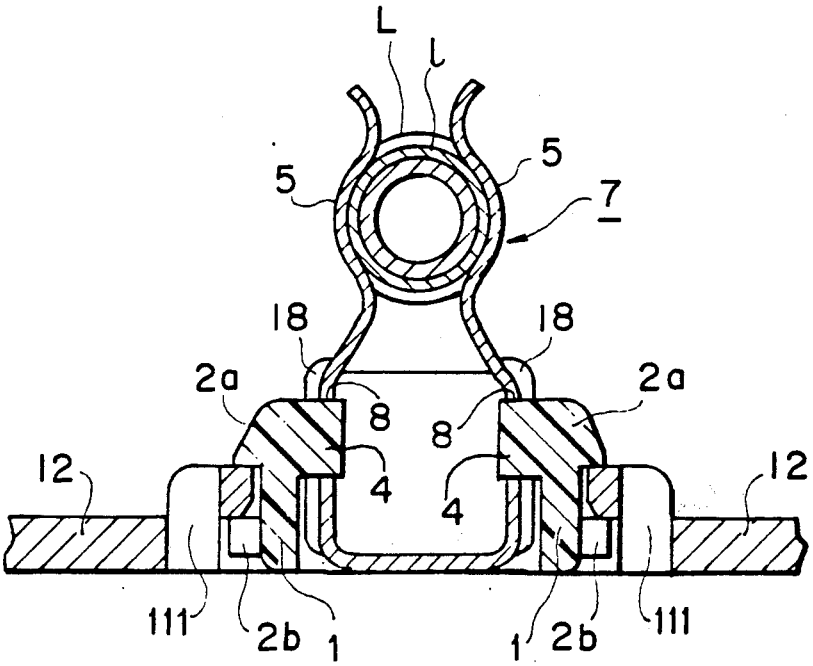
Figure 11B:
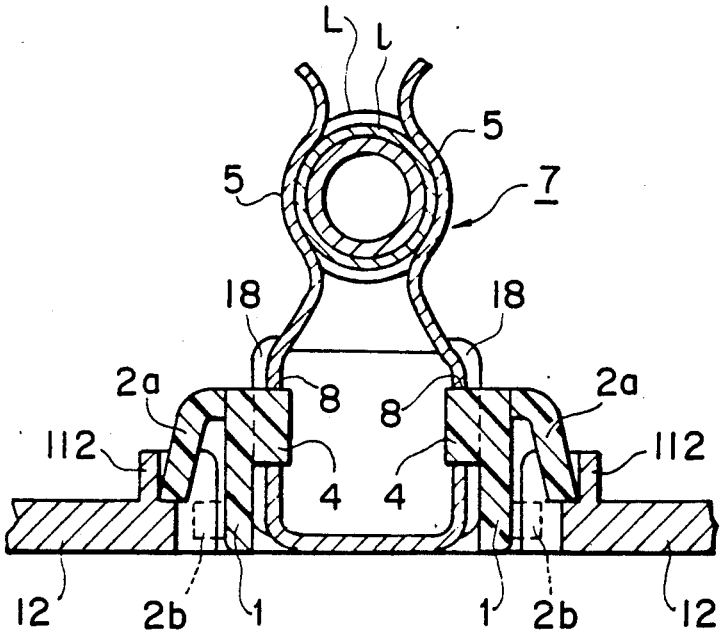
Figure 11C:
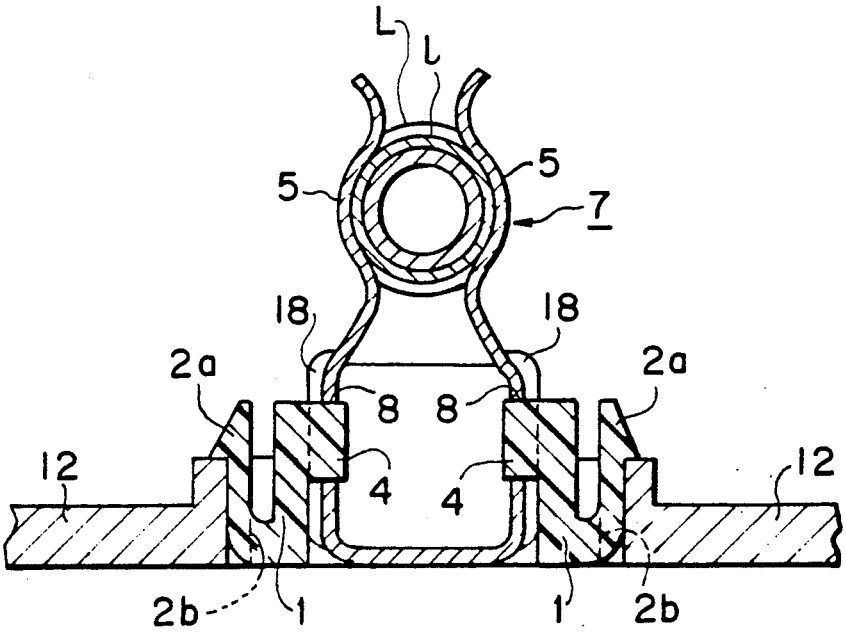
Figure 11D:
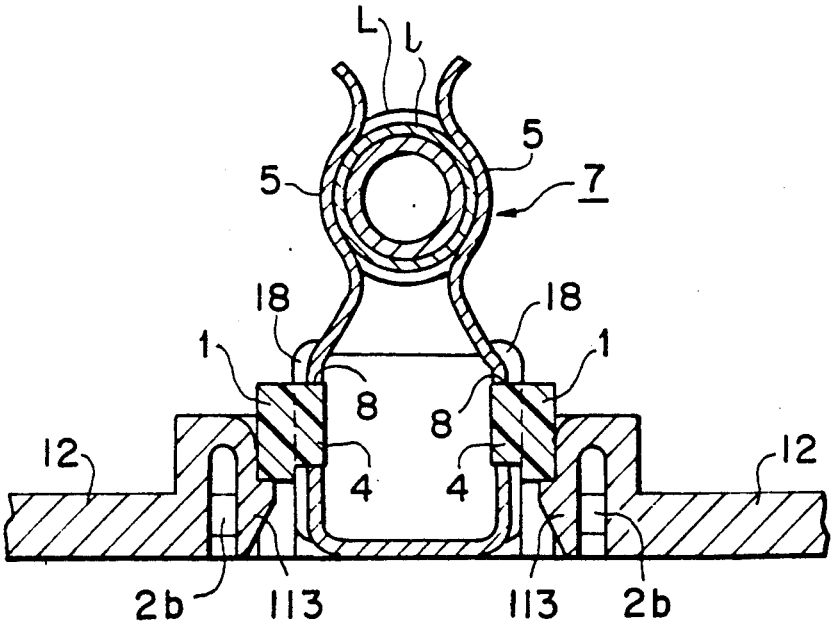

FIGS. 7 through 11A indicated another embodiment of this invention in which the lower surface of insulating base 1 is in the same plane as the lower surface of attaching member 12 in the attached state wherein the inner edge of engaging hole 10 of attaching member 12 is elevated in the form of raised frame as shown in FIG. 11A. Furthermore, in each of the drawings of FIGS. 7 through 11A, those portions that are indicated with the same numbers as the embodiment indicated in FIGS. 1A through 6A are either identical or equivalent to each of the portions indicated in that embodiment.

The following describes a second embodiment of this invention. The basic construction is similar to that of the first embodiment. A description is given of a specific example of the attachment component of the connector in this embodiment referring to FIGS. 1B, 2B, 3B and 6B.

Figure 1B:
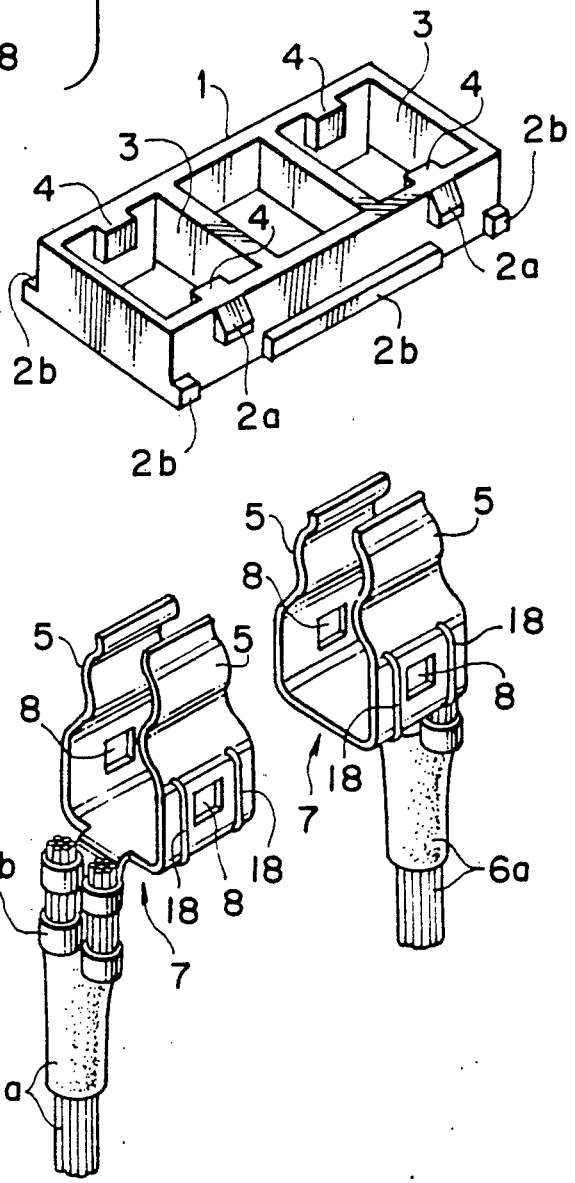

Two insertion holes 3 of the two connectors 7 are formed at a specified interval in the upper surface of the insulating base 1 as shown in FIG. 1B by molding of a heat-resistant plastic such as nylon 66 or polybutylene phthalate. The insertion holes 3 extend through the base 1 to its lower surface. In addition, a pair of projections 4 which engage with the connector 7 are provided on the inner surfaces of the walls that face each other and which define the insertion hole 3.

As shown in FIG. 1B, conducting strips made of conductive leaf spring materials such as phosphor bronze, nickel silver or beryllium copper are stamped out into a severed cross-shaped disc. The strips are then bent into a shape that generally resembles the letter "U" by forming a bottom portion between the arms of the cross and bending the arms upward to from a pair of clamps 5 which serve as the clamping receptacle members. Lead wire connectors 66 (which extend from the bottom sides of the clamps 5) are formed, for example, by bending parallel to these clamps 5. The lead wire connector 66 may furthermore be a simple projection, and moreover, any be soldered or caulked to the bottom section between clamps 5.

Figure 2B:
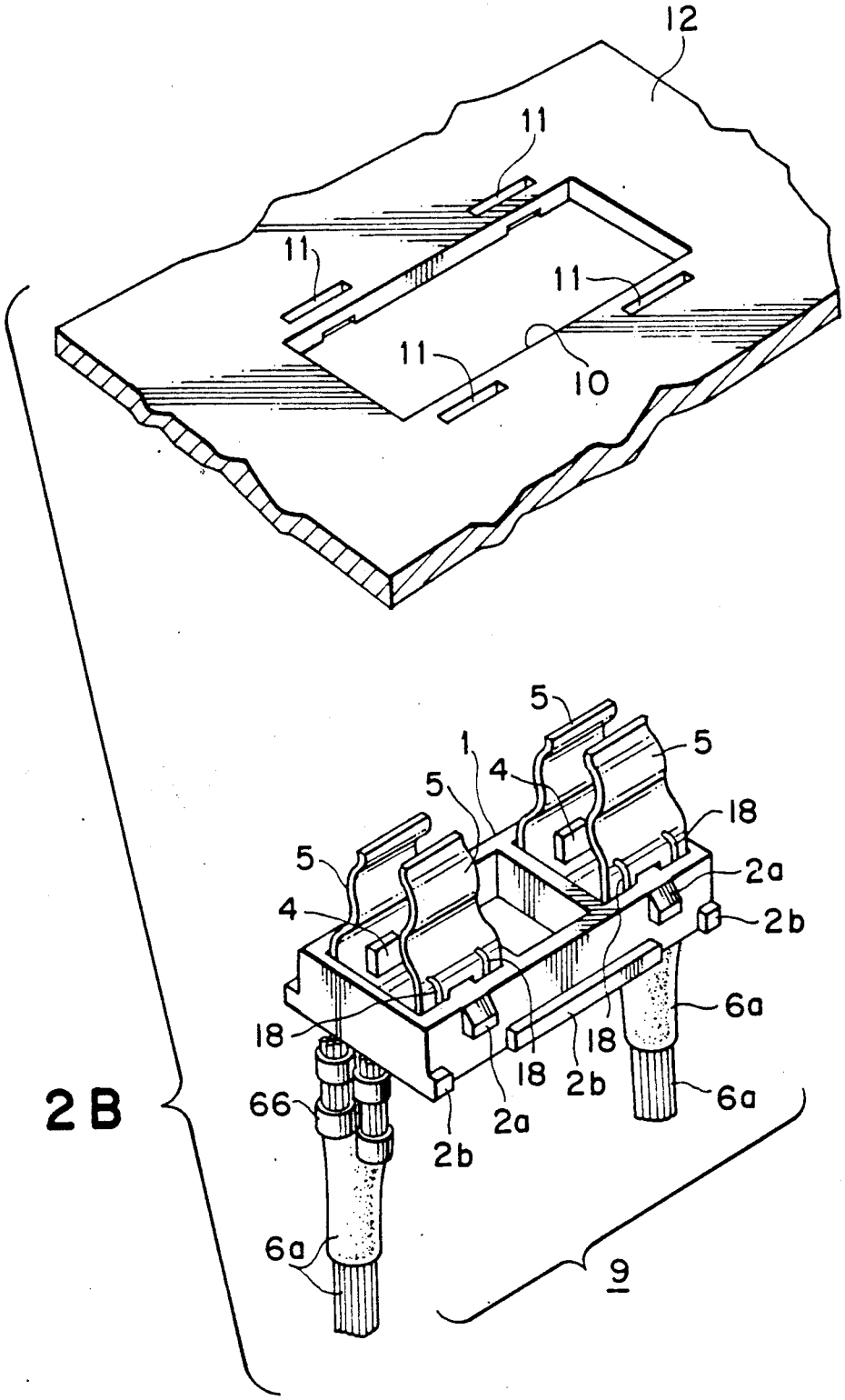

Raised ribs 18 are formed on the bases of the clamps 5 in order to strengthen the attaching holes 8. The raised ribs 18 thereby allow funneling effects to be achieved for dissipation of heat due to gaps that are formed between the inner walls of connector insertion holes 3 and the clamps 5. The projections 4 of the connection insertion holes 3 are adapted to extend into the attaching holes 8. Thus, as shown in FIG. 2B, connectors may be coupled to the projections 4 of the insulating base 1 by pressing them into the insertion holes 3 with a "clicking" action utilizing the resiliency of clamps 5 until the projections 4 extend into the attachment holes 8 that are formed on each of the bases of the pair of clamps 5. In this manner, the connector assembly is formed.

Figure 2C:
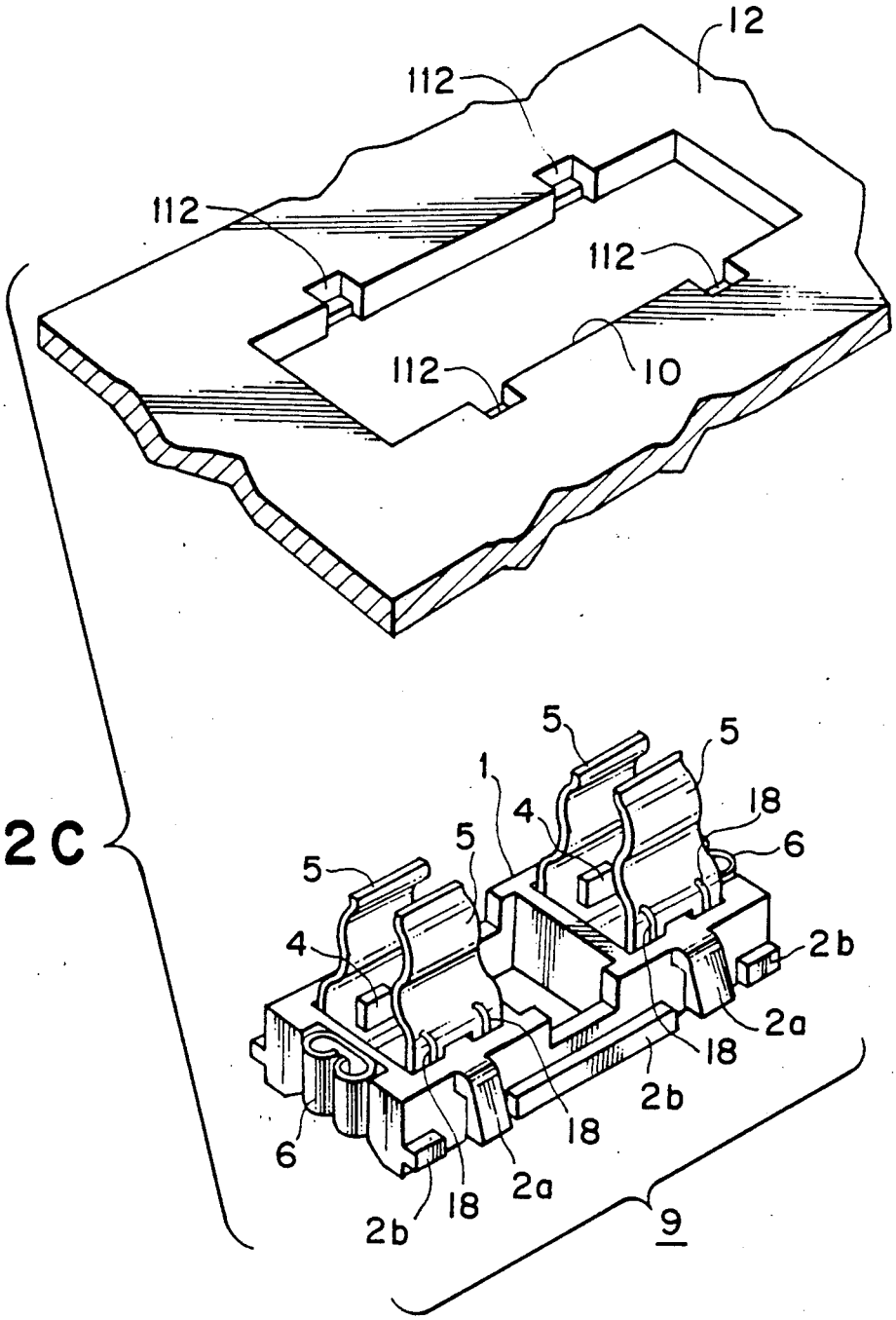

The following describes a third embodiment of this invention having a basic construction similar to that of the first embodiment. A description is given of the attaching member in this embodiment referring to FIGS. 2C, 3C, and 6C. As shown in FIG. 2C, attaching member 1Z is provided with an engaging hole 10 m slightly larger than the flat contour of the insulating base 1 using plastic and metal sheet materials. Attaching member 12 furthermore includes supports 112 consisting of step-like notches at each of the four locations in opposition to the locking tabs 2*a*.

Figure 3C:
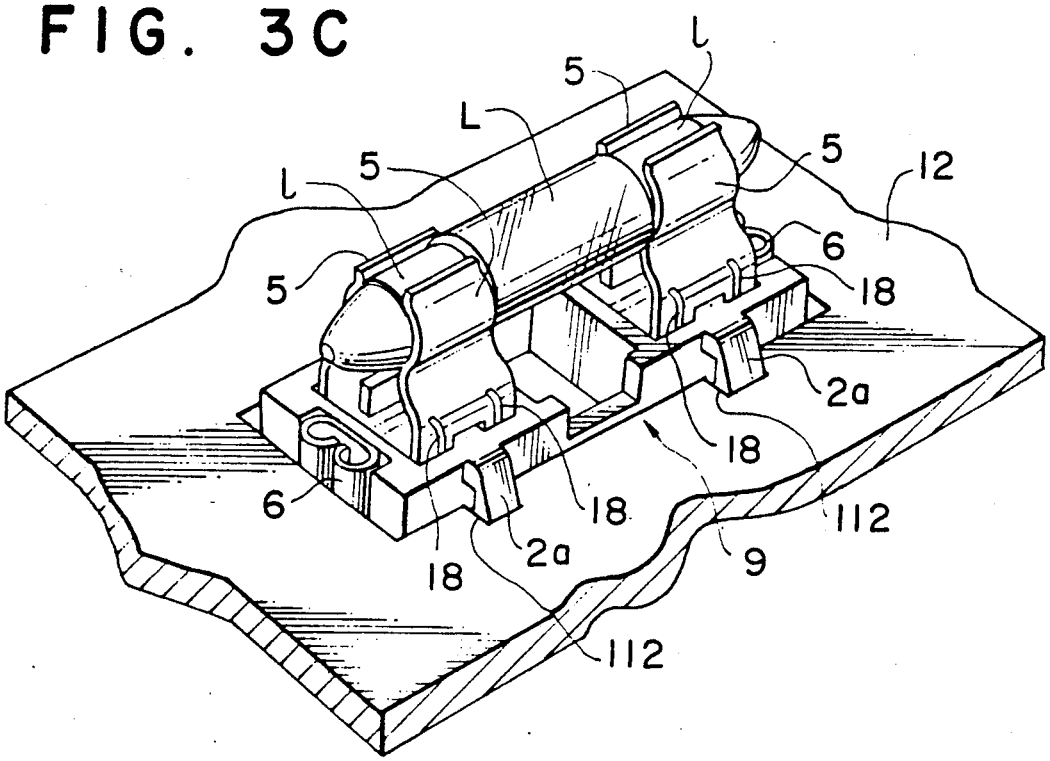
Figure 6C:
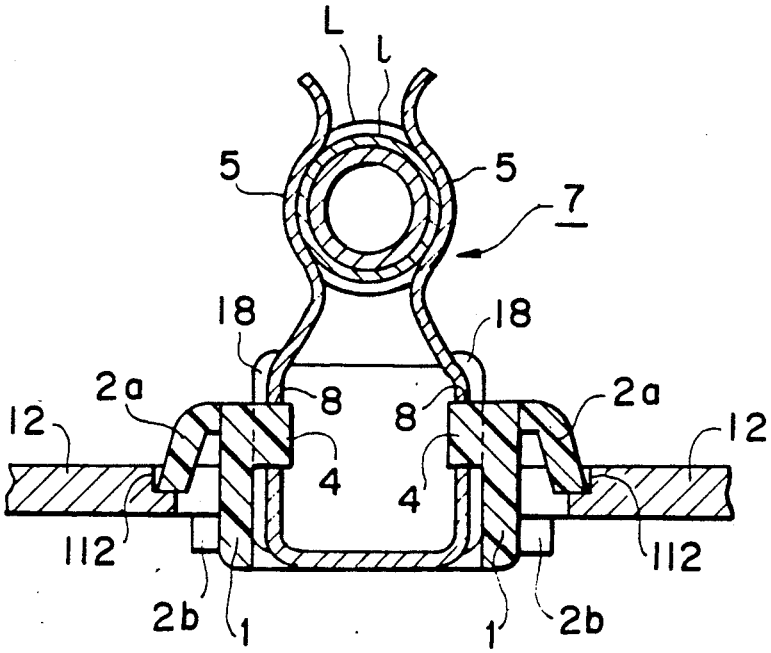

Thus, when the connector assembly 9 is inserted into engaging hole 10 of attaching member 12 to deflect the locking tabs 2*a* to the inside at the inner edge of engaging hole 10 in opposition to their resilient force, the lower ends of locking tabs 2*a* first move away from the upper surface of attaching member 12 and then snap back into place. In such a manner, the connector assembly 9 is able to be engaged with attaching member 12 in the manner of a so-called "cassette locking mechanism" such that it is securely engaged as shown in FIG. 3C and 6C. As a result, the upper and lower surfaces in the vicinity of the inner edge of engaging hole 10 of the supports 112 may be connected to engaging hole 10 and engaged in a single action by means of the lower ends of locking tabs 2*a* and the upper surfaces of flanges 2*b*, respectively.

In addition, as shown in FIG. 2C, attaching member 12 is made of plastic and metal sheet, having engaging hole 10 slightly larger than the flat contour of the insulating base 1, and supports 112 consisting of step-like notches which are formed at each of the locations that are in opposition to the locking tabs 2*a*. Thus, the connector assembly 9 is mounted by inserting it in the manner of FIG. 6C with the inner edge of engaging hole 10 of attaching member 12 engaged between the locking tabs 2*a* and flanges 2*b*.

Since the supports 112 support the ends of locking tabs 2*a*, the supported states of locking tabs 2*a* are able to be maintained. Thus the insulating base 1 does not "rattle" with respect to attaching member 12 even when an external force is applied in a downward direction. Straight lamp L or connection conductors 1 such as glass fuses are used by inserting the same between the pairs of clamps 5.

Figure 6D:
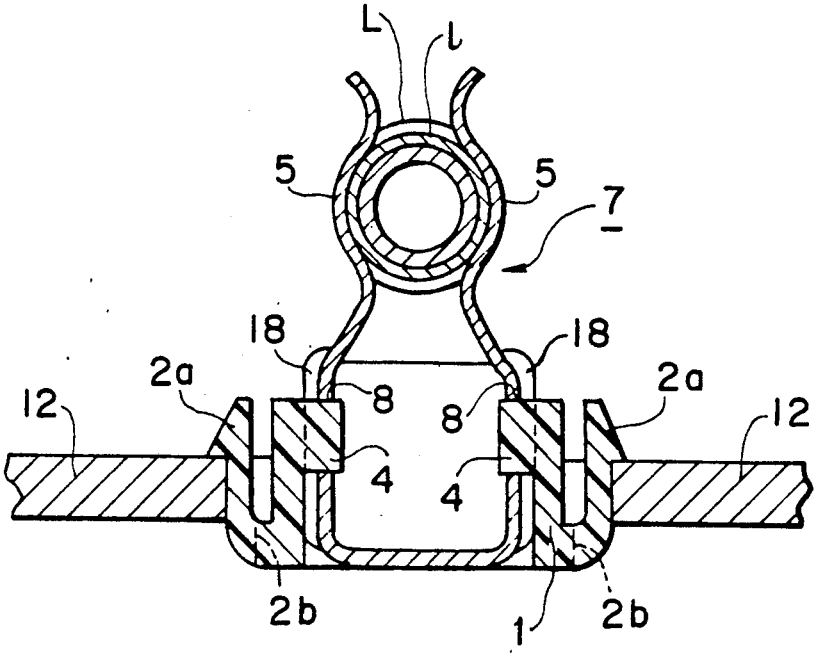

The following describes a fourth embodiment of this invention. In this embodiment, the locking tabs provided on the sides of insulating base 1 are in the form of resilient tabs as shown in FIGS. 2D, 3D and 6D.

Figure 2D:
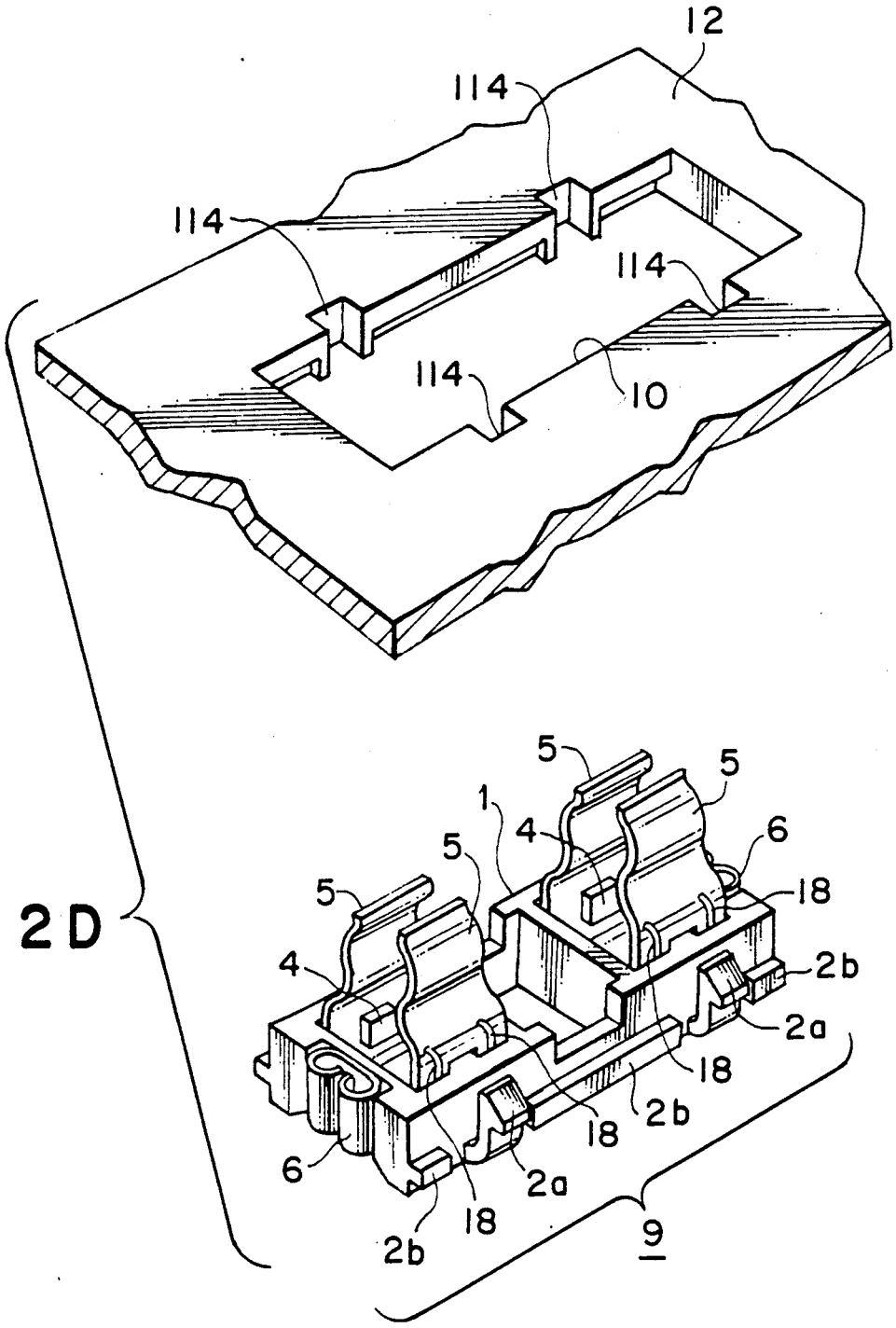
Figure 3D:
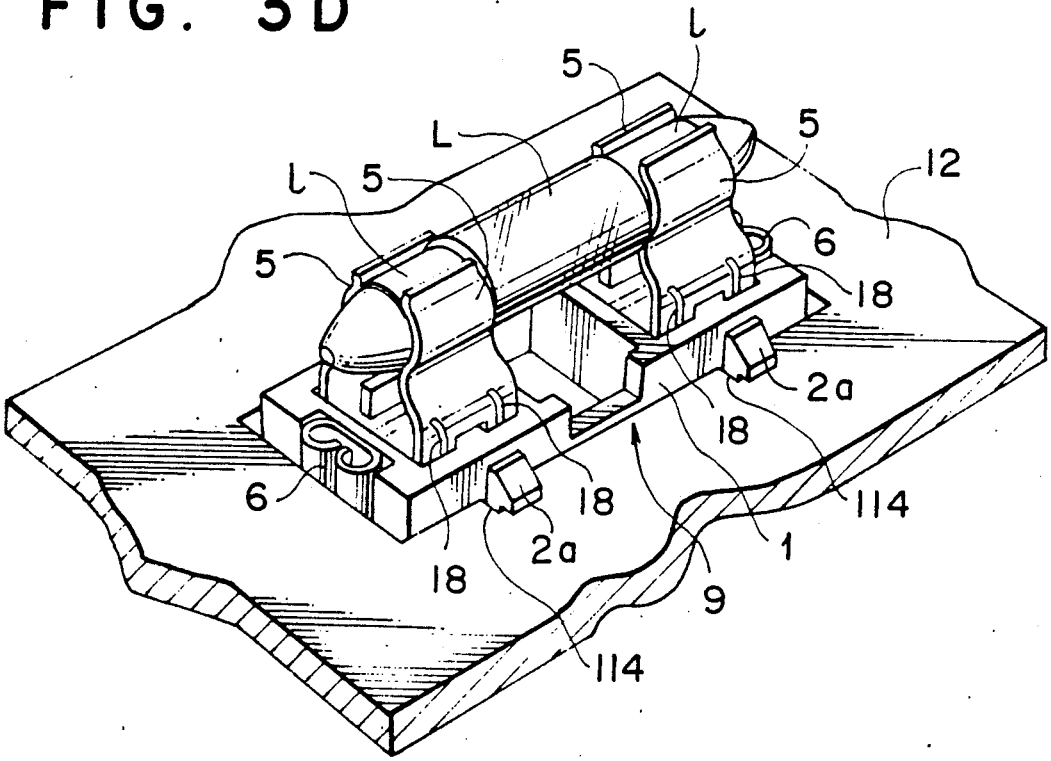

As shown in FIG. 2D, attaching member 12 defines a engaging hole 10 slightly larger than the flat contour of the insulating base 1 using plastic and metal sheet materials. Notches 114 are formed at each of the four locations in opposition to the resilient locking tabs 2*a*. Thus, the connector assembly 9 may be inserted into engaging hole 10 of attaching member 12 causing the resilient locking tabs 2*a* to be deflected to the inside in opposition to their resilient force at the location of engaging hole 10. The inserted state is shown in FIG. 6D.

Figure 12A:
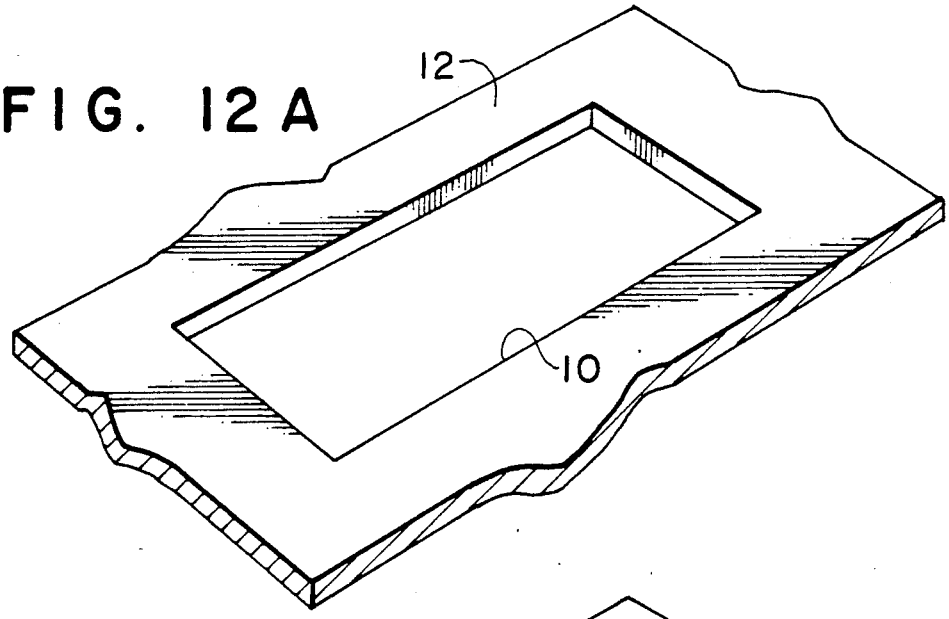
FIG. 12 and FIG. 13 are perspective views and cross-sectional views of another preferred embodiment of this invention.
Figure 12B:
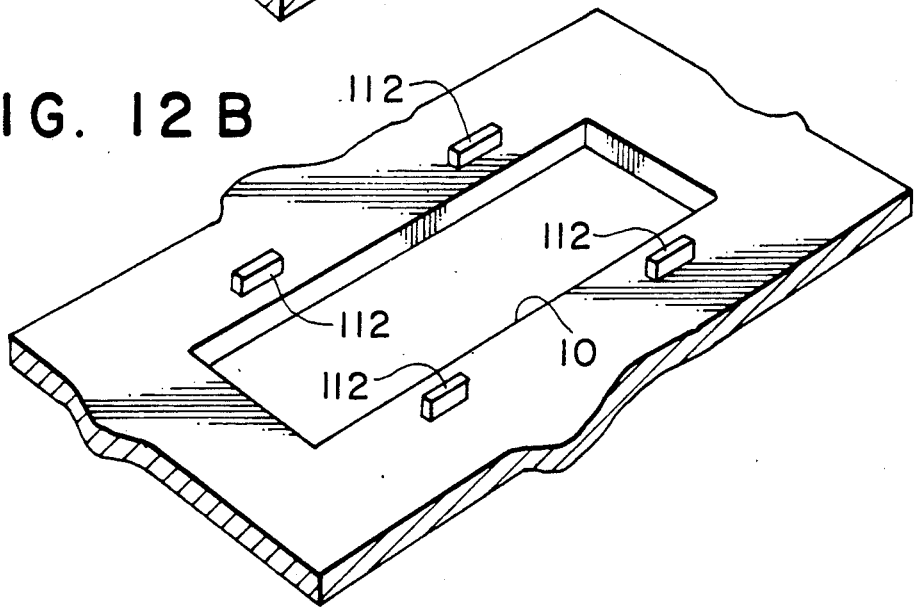
Figure 13:
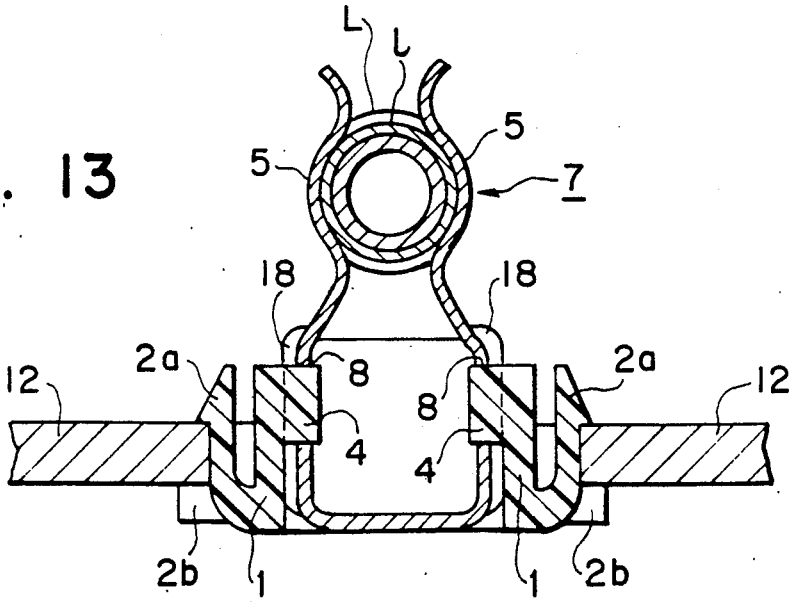

Another embodiment of the invention shown in FIG. 12 and FIG. 13 and has a slot for engaging hole 10 of attaching member 12 with the length of an overhang of flanges 2*b* being made slightly longer.

Figure 2E:
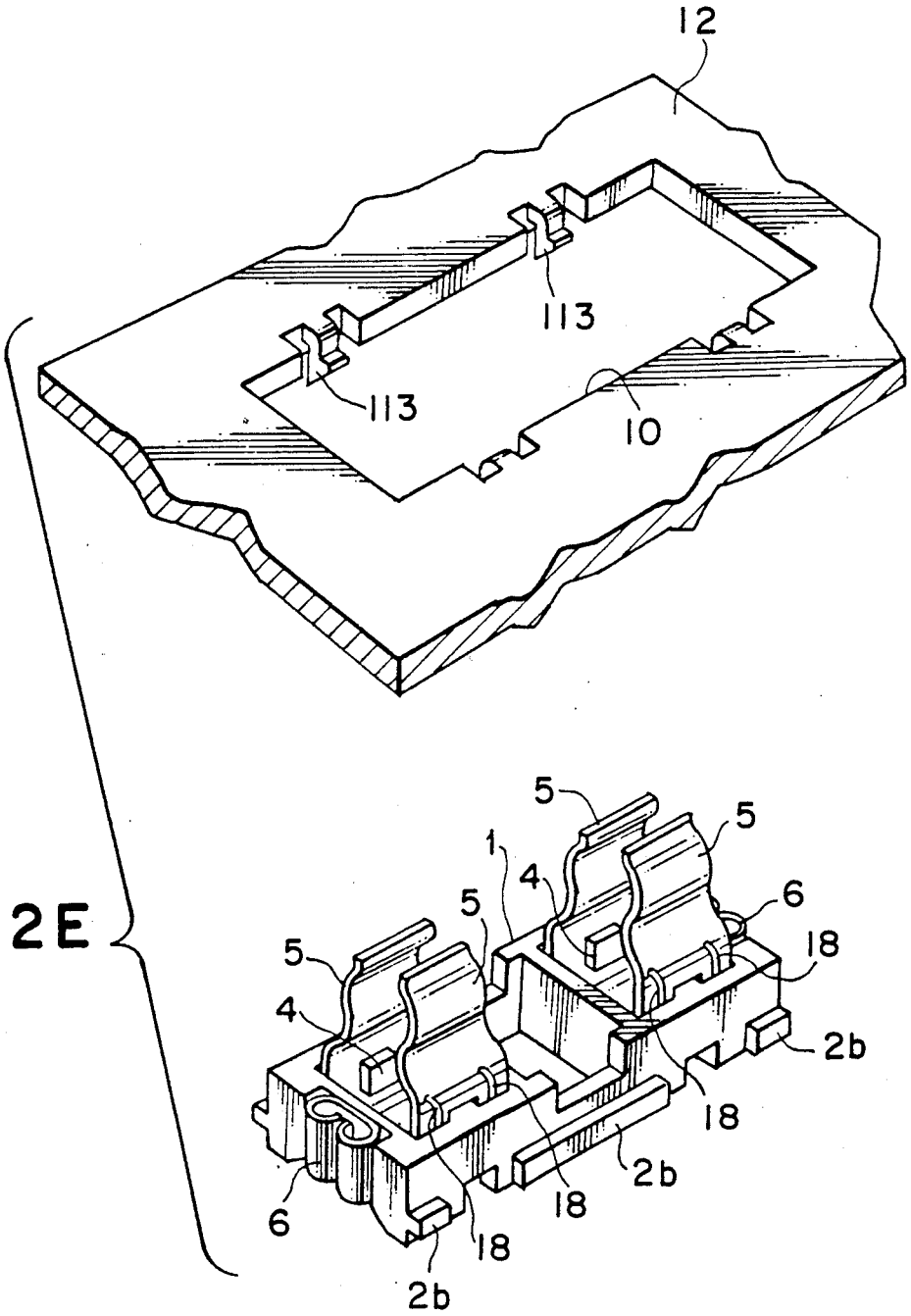

The following describes a fifth embodiment of this invention. As shown in FIG. 2E, the basic construction of this further embodiment consists of a plurality of flanges 2*b* projecting from the side of insulating base 1. As before, insulating base 1 is formed of a heat-resistant plastic molded into the general shape of a rectangular frame. A pair of connector insertion holes 3 are formed in insulating base 1 and include two pairs of projections 4 projecting in opposition to each other from the sides of insertion holes 3. A pair of resilient U-shaped clamps 5 having a plug-in receptacle 6 are formed into a single unit with one such unit being provided for each of the two connectors 7.

The two connectors 7 are mounted into the pair of connector insertion holes 3 such that the pair of projections 4 extend through attachment holes 8 formed in the bases of the clamps 5, hereby forming the connector assembly 9 as shown in FIG. 2E.

As shown in FIG. 2E, in addition to being provided with an engaging hole 10 slightly larger than the flat contour of the insulating base 1, attaching member 12 includes resilient hooks 113 projecting downwardly on the edge of engaging hole 10.

Figure 3E:
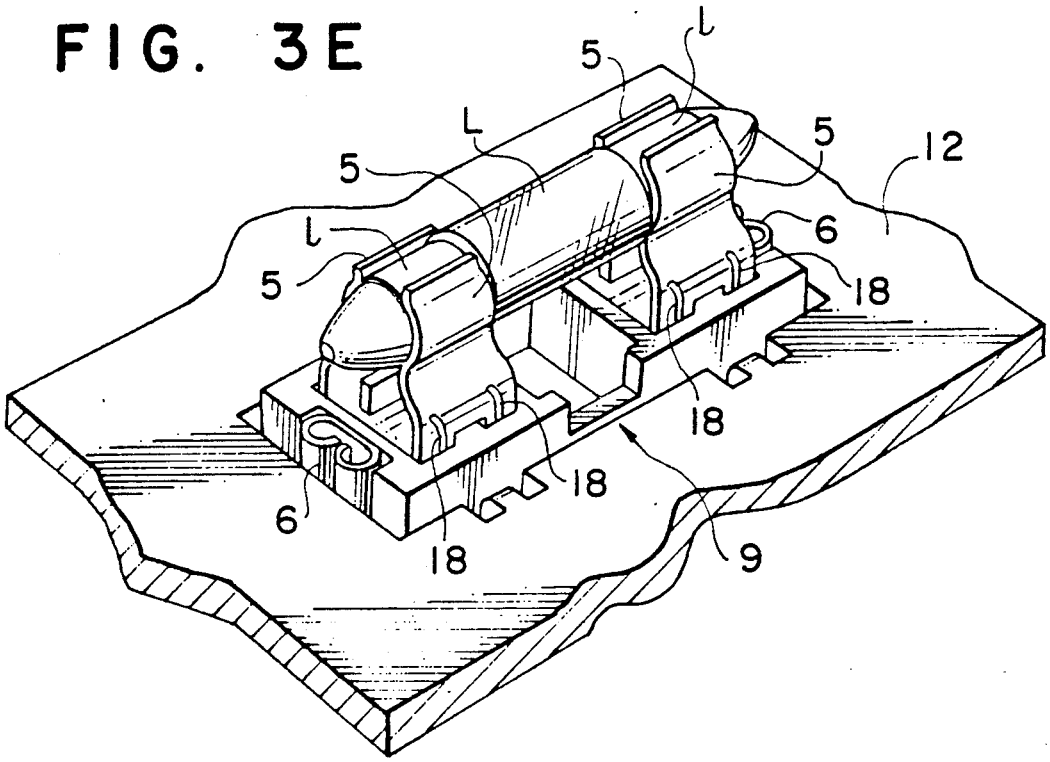
Figure 6E:
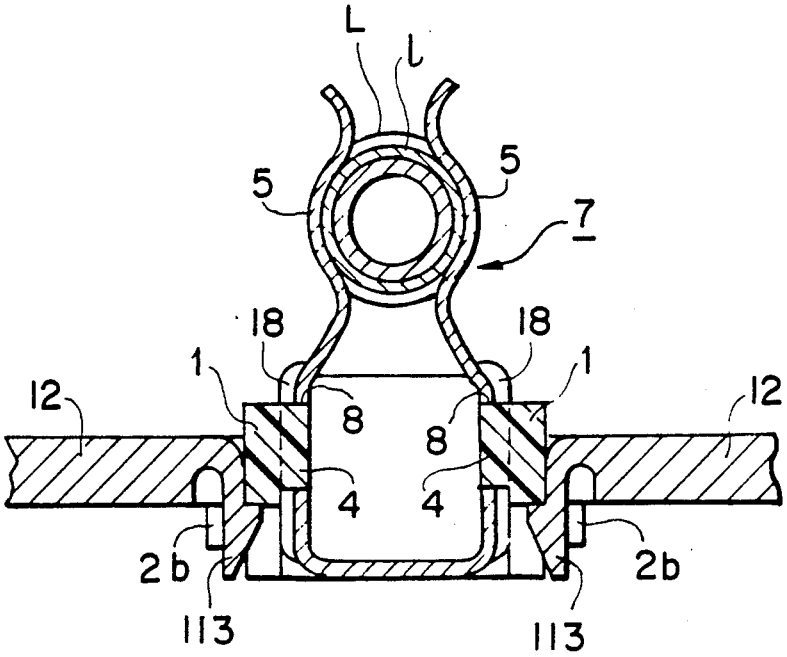
Figure 6F:
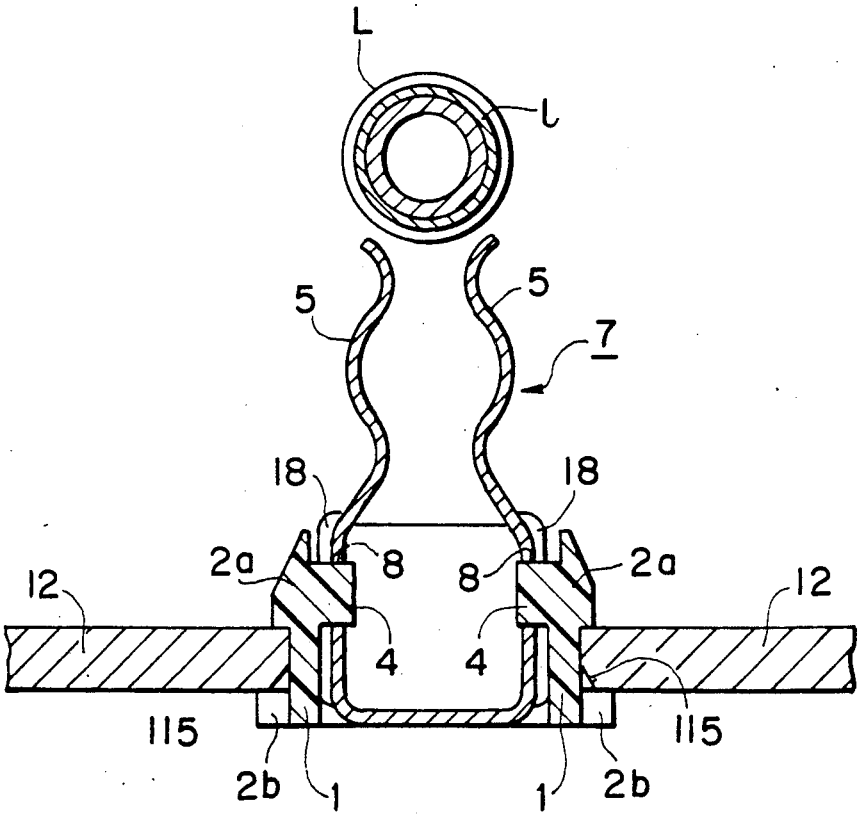
Figure 7:
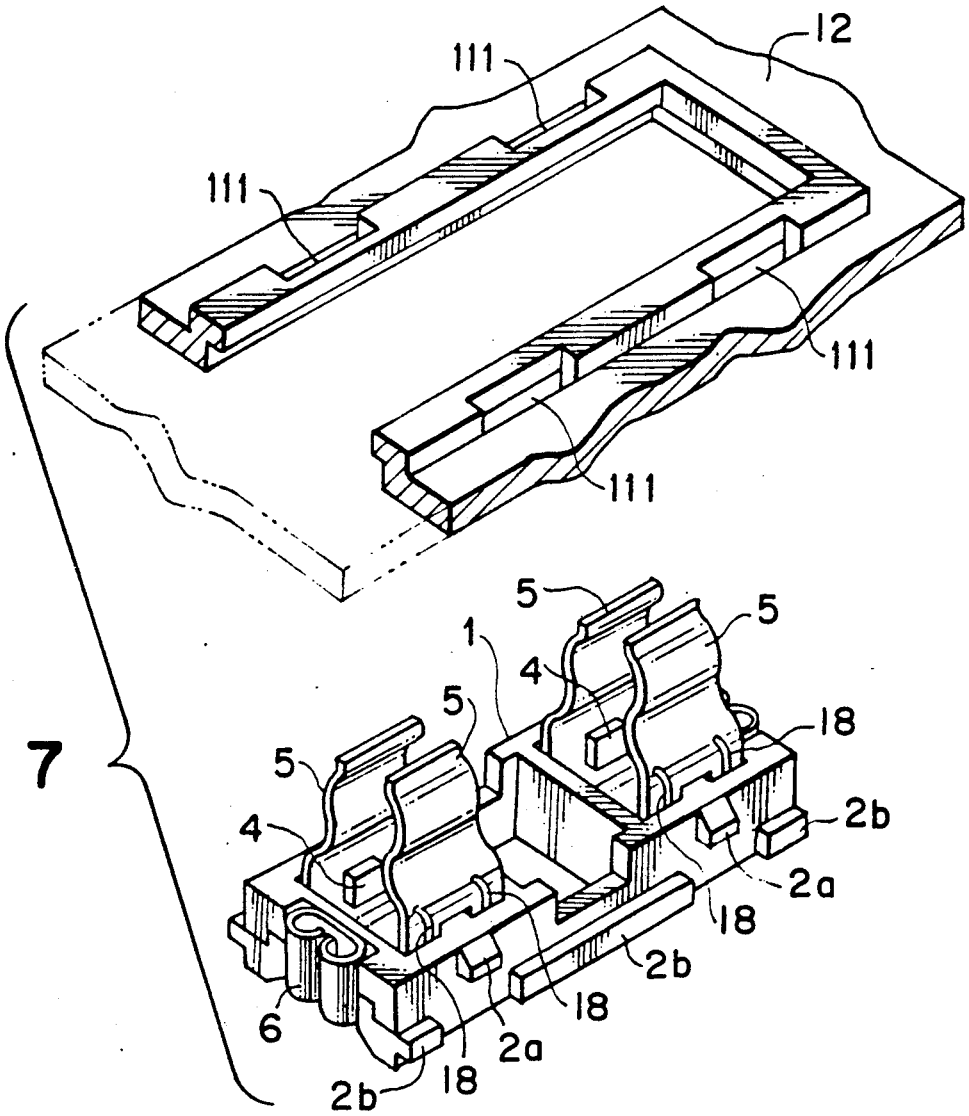
FIG. 7 is a perspective view of the attaching material and connector assembly of a preferred embodiment of this invention.
Figure 8:
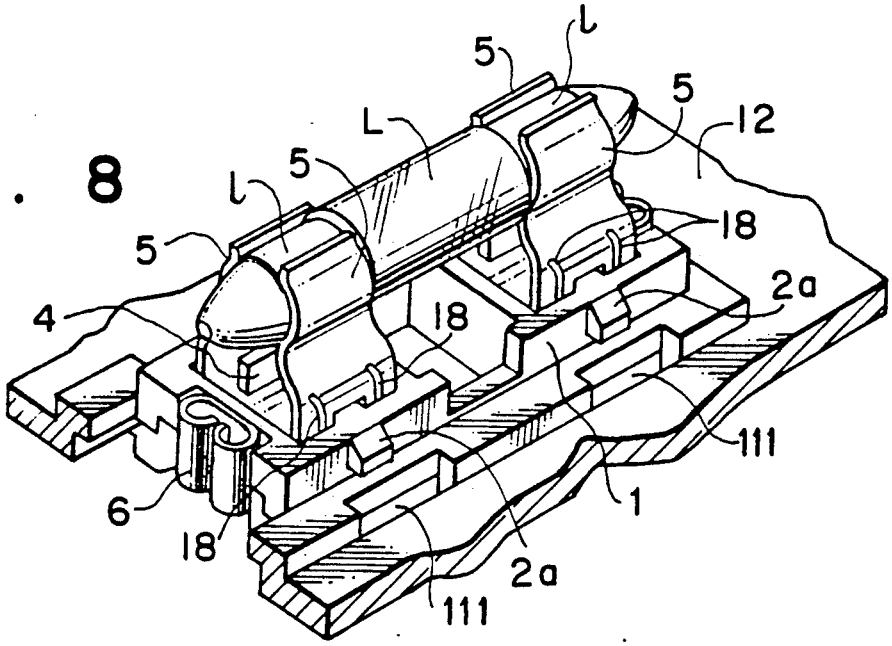
FIG. 8 is a perspective view following assembly of that mentioned above.
Figure 9:
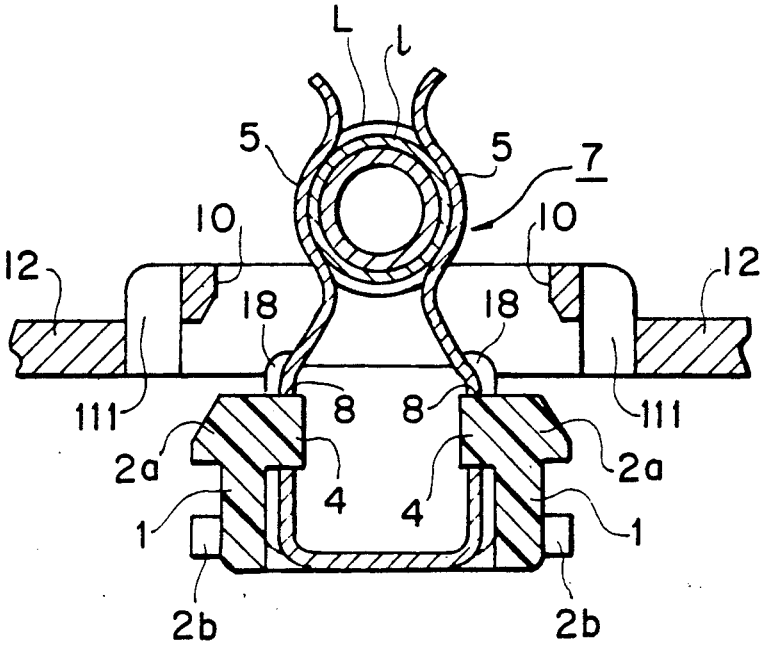
FIG. 9 through FIG. 11E are cross-sectional views which depict the procedure by which the insulating base is attached to the attaching member of another preferred embodiment of this invention.
Figure 10:
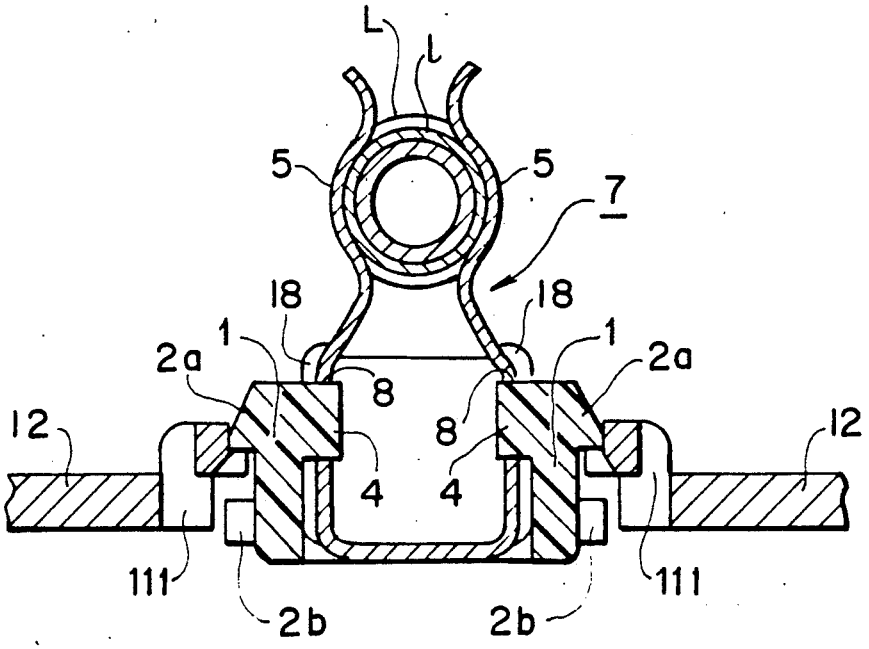

Thus, when the connector assembly 9 is inserted into engaging hole 10 of attaching member 12 in opposition to the resilient force of resilient hooks 113, resilient hooks 113 first move away from the lower edge of insulating base 1 and then snap back into their original position. The connector assembly 9 is able to be attached to attaching member 12 in the manner of a so-called "one touch operation" such that the hook surfaces of resilient hooks 113 make contact with the lower surface of insulating base 1 while the flanges 2*b* make contact with the lower surface of attaching member 12 as shown in FIGS. 3E and 6E.

Figure 2F:
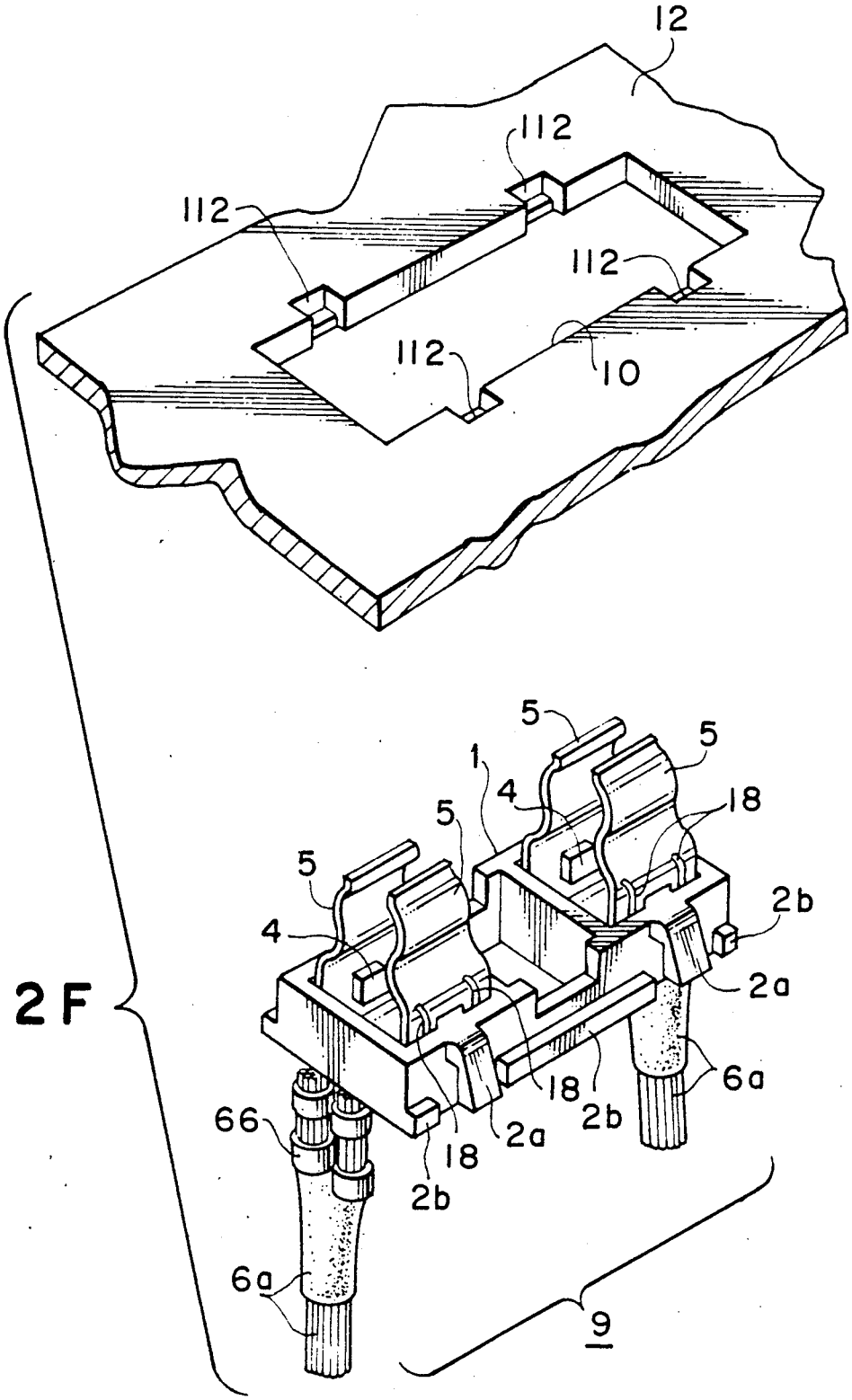
Figure 3F:
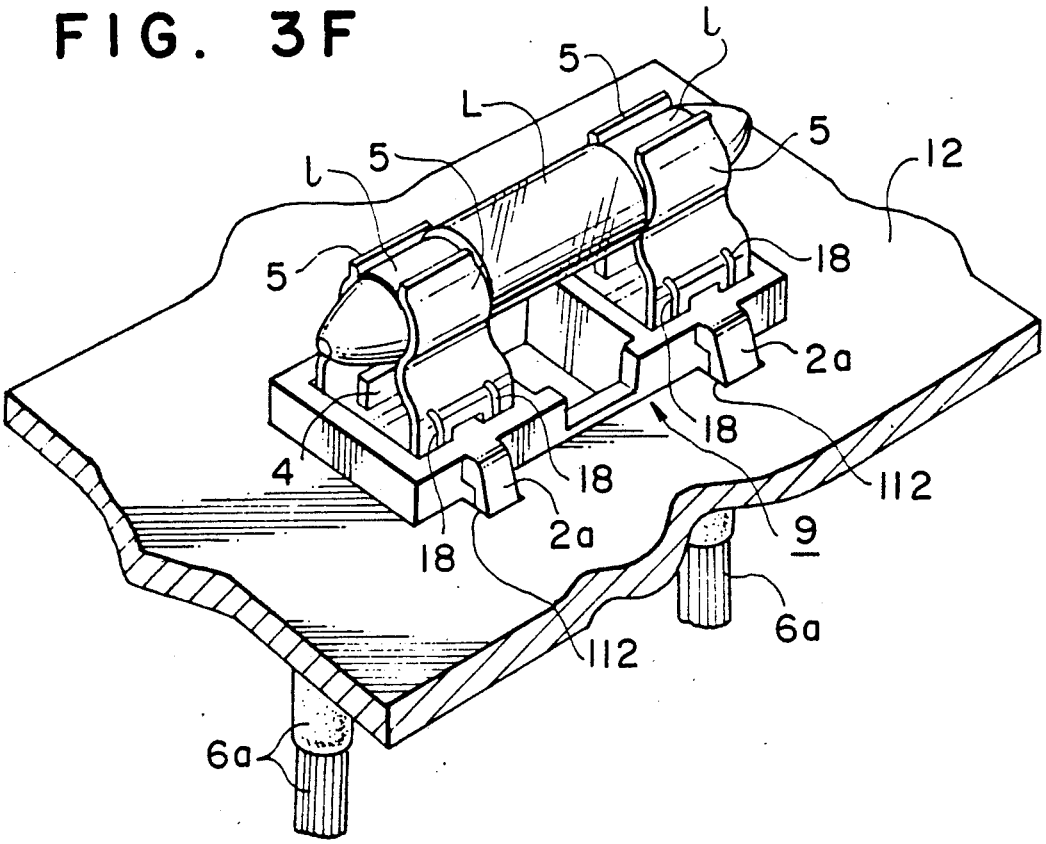

The following describes a sixth embodiment of this invention. Although the basic composition is similar to the third embodiment of this invention, as shown in FIGS. 2F, 3F and 6G, each of the two connectors 7 that is used in this embodiment is equipped with lead wires 6 and clamps 5 forming resilient U-shaped conductive strips as shown in FIG. 1B.

Figure 2G:
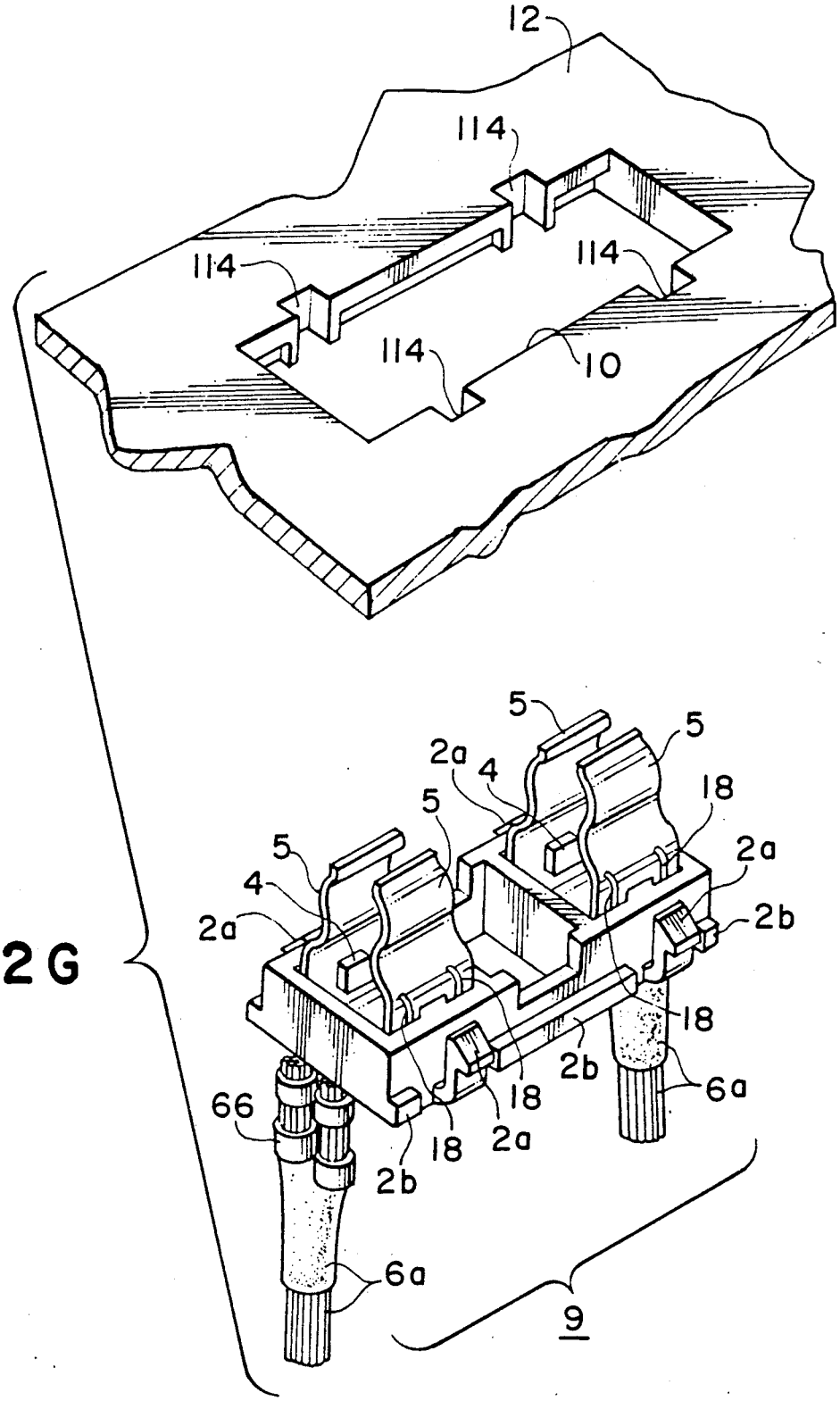
Figure 3G:
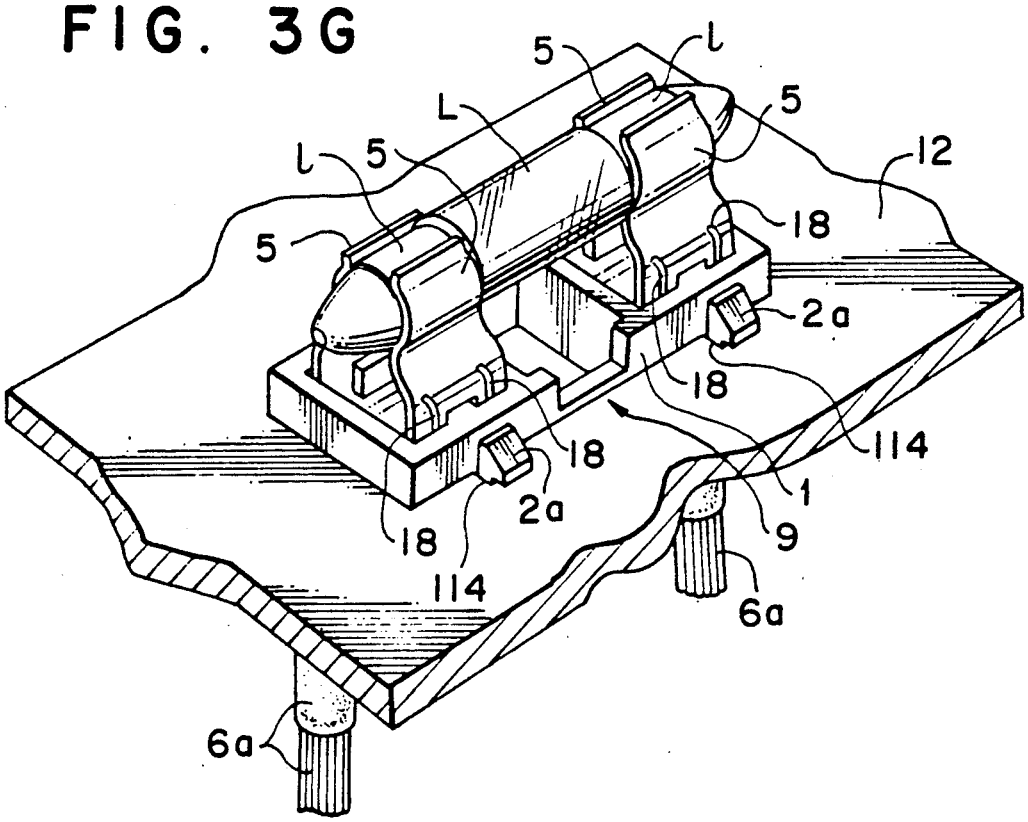

The following describes a seventh embodiment of this invention. The basic construction of this embodiment is similar to that of the fourth embodiment and has the characteristic of using connector 7 equipped with lead wire 6*a* as shown in FIGS. 2G, 3G and 6G for each of the two connectors.

Figure 2H:
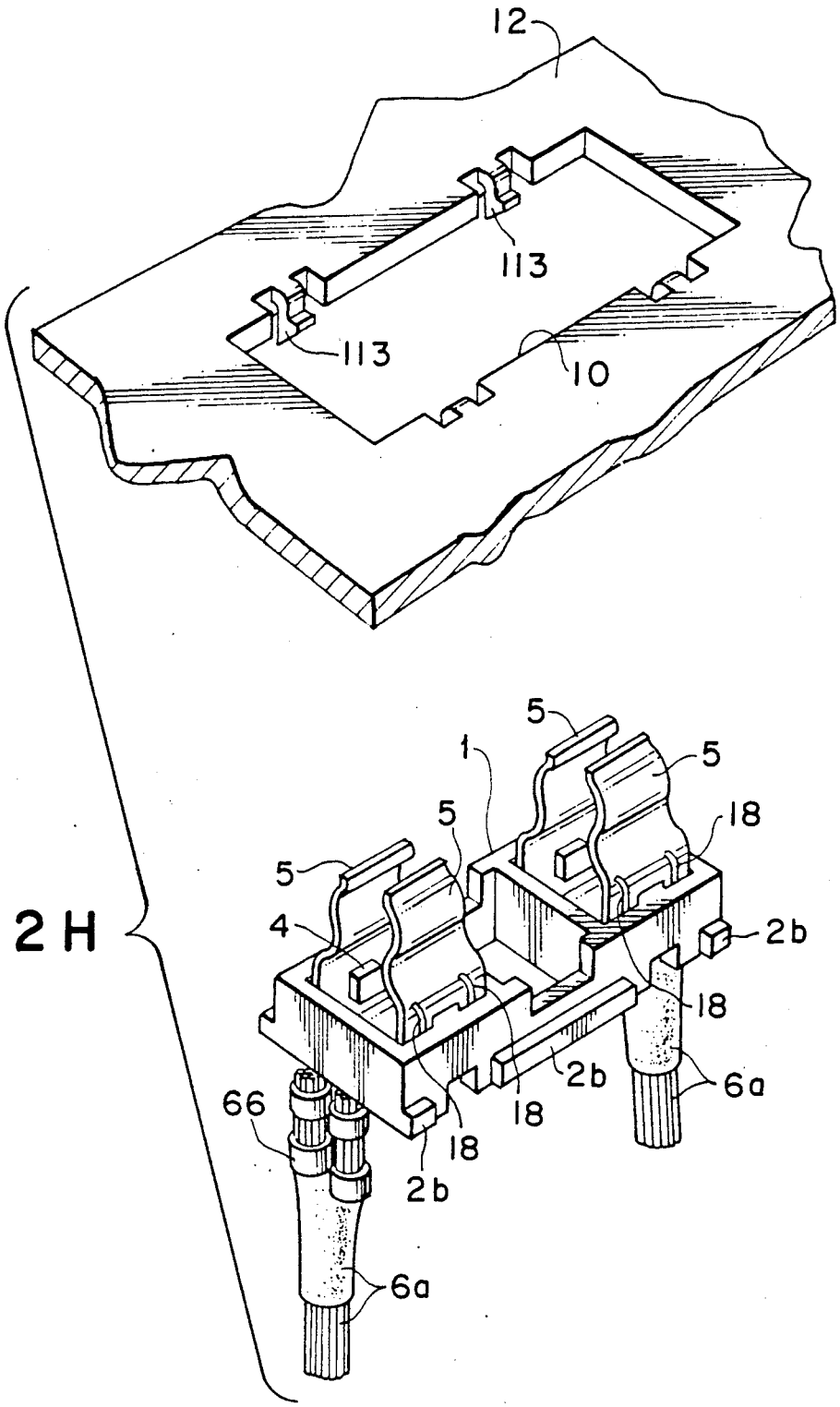
Figure 3H:
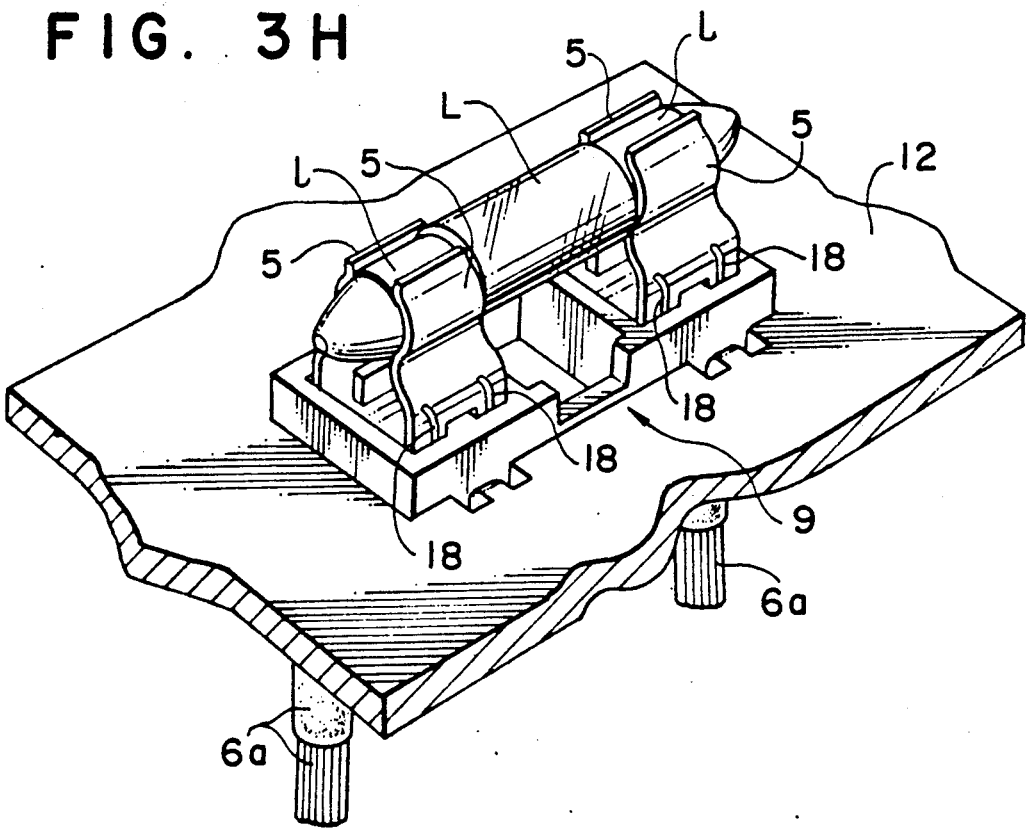

The following describes an eighth embodiment of this invention. The basic construction is similar to that of the fifth embodiment and has the characteristic of using connector 7 equipped with lead wire 6*a* as shown in FIGS. 2H 3H and 6H for each of the two connectors.

A ninth embodiment of this invention is shown in FIG. 21. As is shown therein, the basic construction of this embodiment consists of a plurality of locking tabs 2*a* and flanges 2*b* projecting from the side of insulating base 1. Insulating base 1 is again formed of a plastic and molded into the shape of a nearly rectangular frame. A pair of connector insertion holes 3 are formed in insulating base 1, and include two pairs of projections 4 projecting in opposition to each other from the sides of insertion holes 3. In addition, a pair of resilient U-shaped clamps 5 and a plug-in receptacle 6 are formed into a single unit with one such unit being provided for each of the two connectors 7. The two connectors 7 are mounted into the pair of connector insertion holes 3 with the pair of projections 4 through attachment holes 8 formed in the bases of the clamps 5, thus forming connector assembly 9.

Attaching member 12 defines an engaging hole 10 that is slightly larger than the flat contour of the insulating base 1.

Figure 3I:
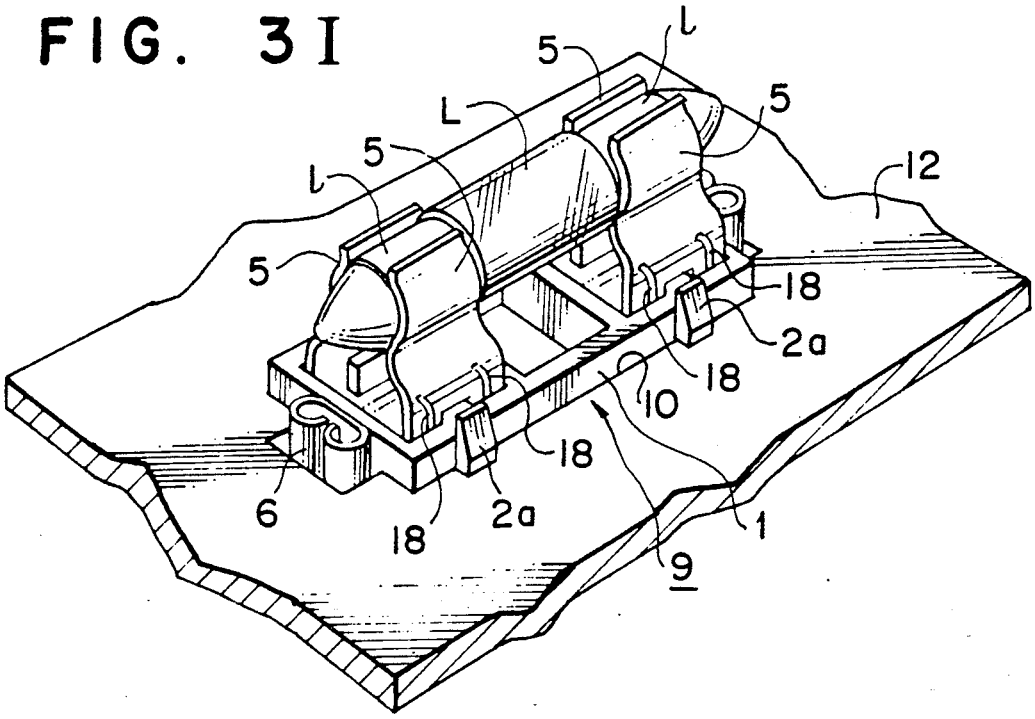

The connector assembly 9 may thus be engaged with the attaching member 12 at engaging hole 10 as shown in FIGS. 3I and 6I with the locking tabs 2*a* and the flanges 2*b*.

Figure 2I:
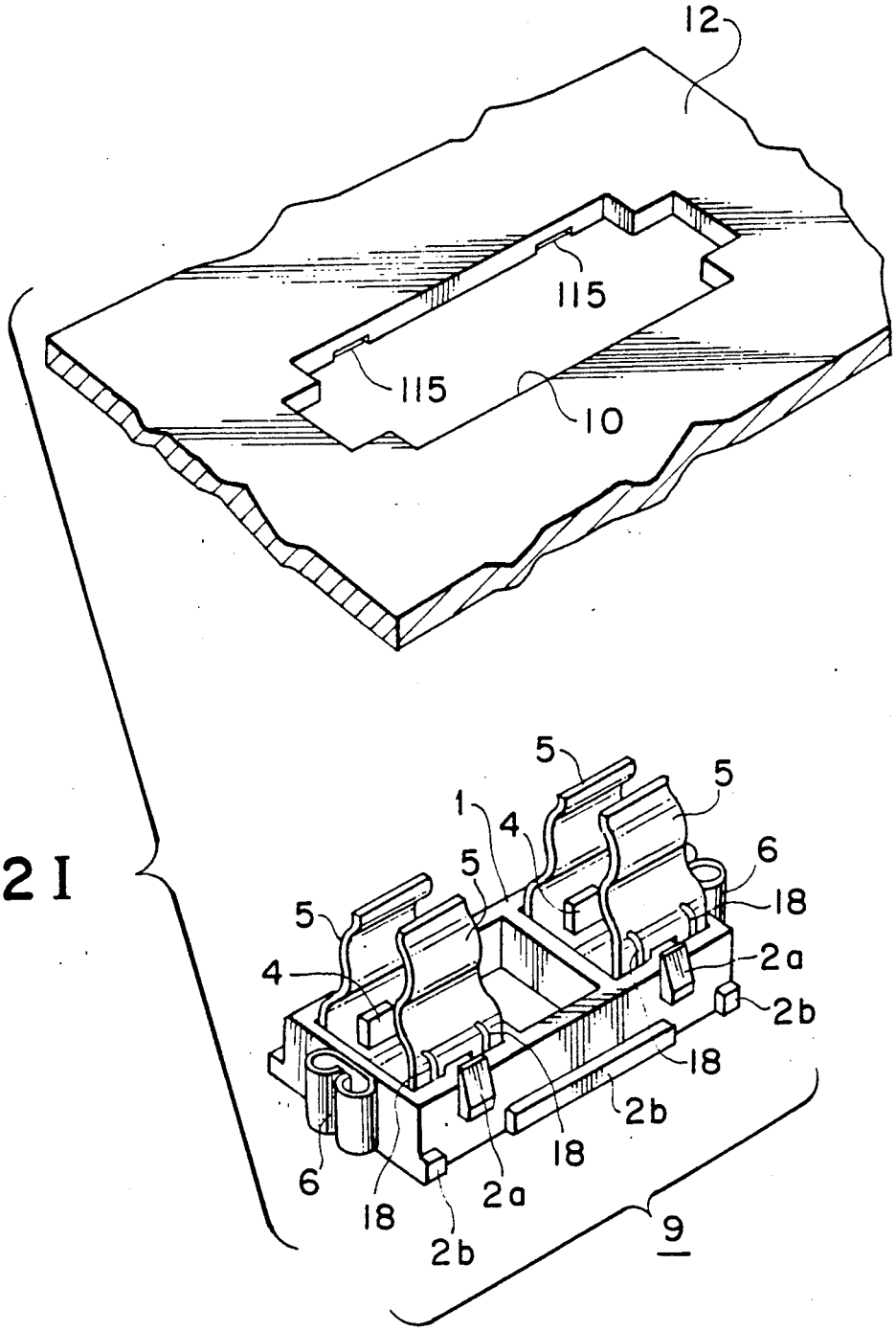

Thus, as shown in FIG. 2I, connectors 7 fit inside projections 4, that are provided in position to each other on the opposing inner walls of connector insertion holes 3 of the insulating base 1, with a clicking action utilizing the resiliency of clamps 5 until the projections 4 extend through the respective attachment holes 8.

In addition, the attaching member 12 includes beveled notches 115 located in its lower surface at each location corresponding to the location of the locking tabs 2*a*. These projections 15 thus function as insertion guides for locking tabs 2*a*.

Thus, the connector assembly 9 is inserted into engaging hole 10 of attaching member 12 as shown in FIG. 6I and mounted in position with the locking tabs 2*a* and flanges 2*b* as shown in FIG. 3I.

Figure 2J:
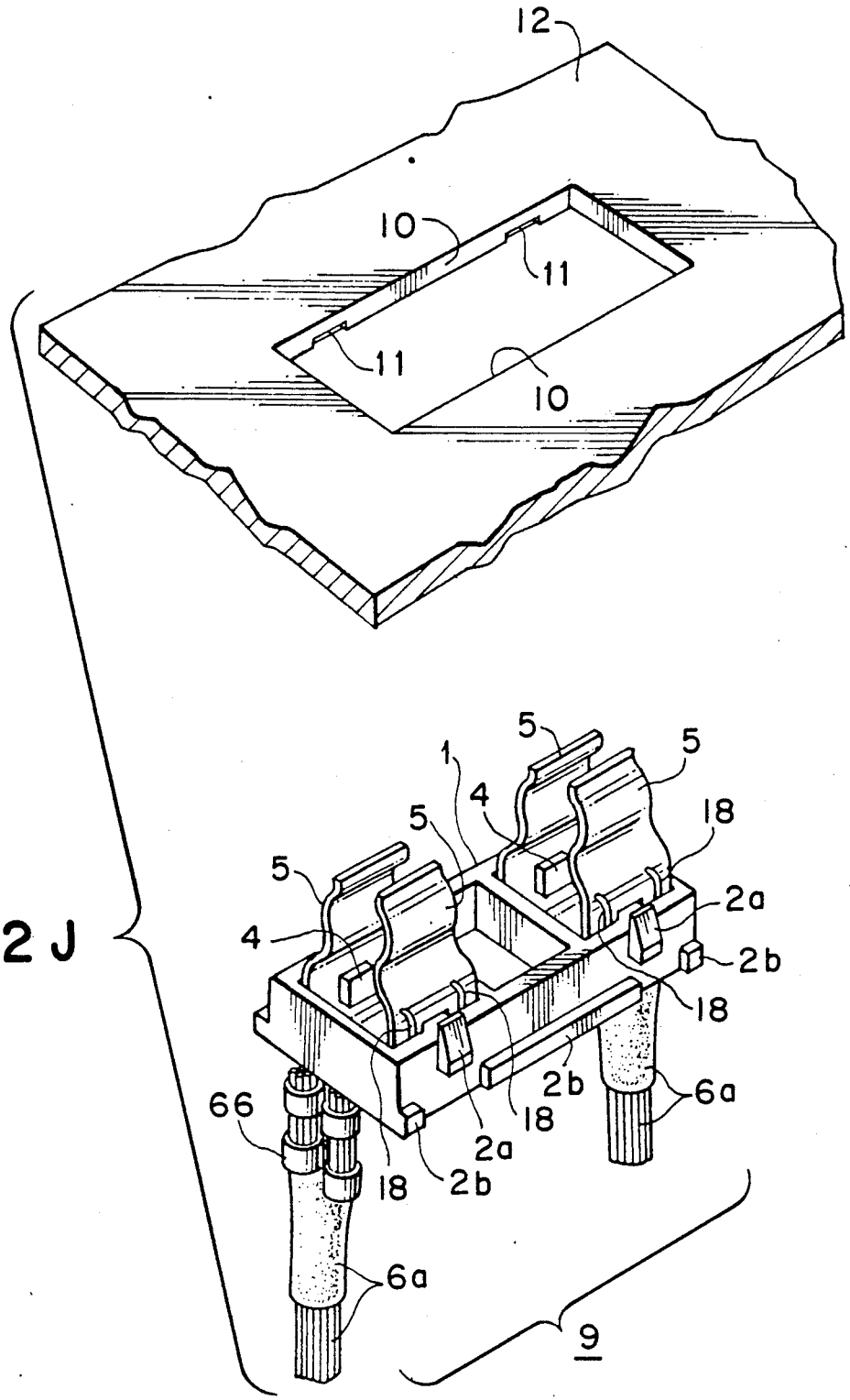
Figure 3J:
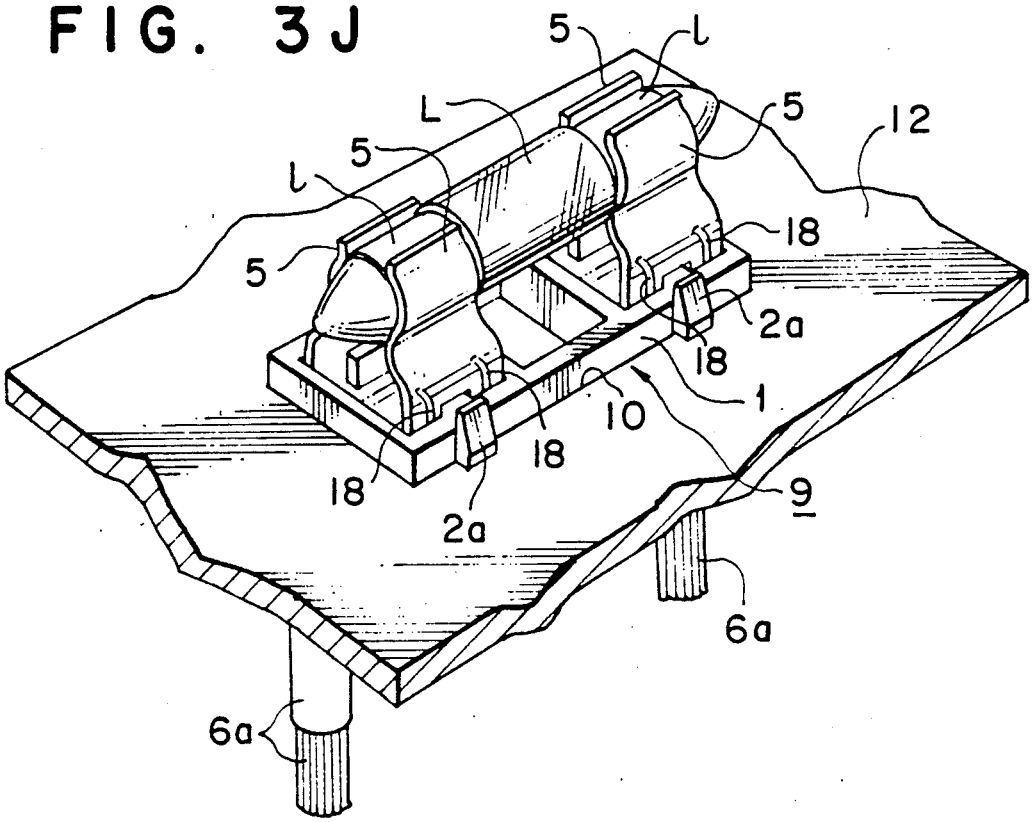

The following describes a tenth embodiment of this invention, the basic construction of which is similar to that of the ninth embodiment and has the characteristic of using connector 7 equipped with lead wire 6*a* as shown in FIGS. 2J, 3J and 6J for each of the two connectors.

Since the invention is constructed as has been described in the previous explanations, the present invention offers the following advantages as will be understood from the following discussion.

In the attachment component of the connector of this invention, the locking tabs 2*a* are formed on insulating base 1 of connector assembly 9 and are securely molded in a single unit with insulating base 1. The locking tabs 2*a* are therefore mechanically strong thereby preventing indiscriminate movement of the insulating base after it is mounted onto the attaching member. In addition, in the assembled components of connectors 7, since connectors 7 are surrounded by insulating base 1, the invention allows the two connectors 7 to be mounted with favorable compatibility through insulating base 1 regardless of whether they are mounted on conducting or insulating plates. Furthermore, since insulating member 1 is comparatively small in size (and thereby requires only a minute amount of resin to make), it achieves adequate cost effectiveness even if it is molded from relatively expensive, heat-resistance plastic. It also has the advantage of being lower in overall cost since it does not require the use of expensive, heat-resistant plastic for the comparatively large insulating sheet use for the attaching member.

In this invention in particular, in the case of installing a large number of straight lamps or fuses in a confined area, since insulating base 1 with the two connectors already engaged can be mounted in the manner of a so-called "cassette locking mechanism" within engaging hole 10 of attaching member 12 with locking tabs 2*a*. The invention thus has another advantage of allowing the straight lamps or fuses to be arranged and installed easily and systematically. Moreover, the embodiment of this invention in which a pair of clamps 5 and a plug-in receptacle 6 having a plug-in connector are formed on a single connector 7 can be manufactured at a low cost both in terms of conserving space and conserving resources. Moreover, a straight lamp or glass fuse may be securely held by the pairs of clamps 5, as well as allowing a direct connection of a tab terminal or BUS bar by securely inserting the same into the plug-in receptacles 6. Soldering and caulking tools required in the prior art are thus no longer necessary. As a result, the invention advantageously allows connection work to be performed easily even in confined and dark areas (such as that in the engine compartment of an automobile.

We claim:

1. A connector assembly for electrical components which includes a connector subassembly, and an attachment member to which said connector subassembly is coupled, wherein (1) said attachment member includes interior edges which define an engaging hole sized and configured to accept said connector subassembly therewithin, (2) said connector subassembly includes:

an electrically insulating base having a pair of opposed exterior wall surfaces, paired locking tabs and flanges extending outwardly from respective ones of said exterior wall surfaces of said insulating base, said locking tabs and said flanges of each said pair being vertically spaced from one another to define an engagement space therebetween for accommodating respective portions of said interior edges of said attachment member, connector insertion holes, a pair of connectors mounted within said connector insertion holes of said insulating base, each said connector integrally including (i) a resilient U-shaped connector portion for holding an electrical component and for establishing electrical connection therewtih, and (ii) a plug-in receptacle for receiving a terminal portion of an electrical lead, and wherein said electrically insulating base is positioned within said engaging hole defined by said interior edges of said attachment member, and is coupled to said interior edges of said attachment member by means of said paired locking

2. A connector assembly for electrical components comprising:

a base molded into a nearly rectangular-shaped frame from an electrically insulating material;

a plurality of locking tabs and flanges projecting from lateral sides of said insulating base, said locking tabs being paired with said flanges so as to define an engagement space between each pair of said locking tabs and flanges;

a pair of connector insertion holes formed in said insulating base;

opposing paris of projections projecting from respective opposing surfaces of said connector insertion holes;

a pair of connectors each positioned within a respective one of said connector insertion holes of said insulating base, each said connector integrally including (i) a U-shaped resilient clamp portion formed of an electrically conductive strip, and (ii) a plug-in receptacle portion, each said U-shaped resilient clamp portion including a base member defining attachment holes which are engaged with a respective opposed pair of said projections for attaching said U-shaped clamp to said insulating base;

an attaching member having interior edges which define an engaging hole sized and configured to accept the exterior periphery of said insulating base therewithin, wherein respective portions of said interior edges of said engaging hole are received by said engaging spaces defined between said pairs of locking tabs and flanges, whereby said insulating base is fixedly coupled to said attaching member, and wherein said attaching member includes relief slots formed in said attaching member at locations in opposition to said locking tabs.

3. A connector assembly for mounting elongate electrical components and for establishing electrical connection therewtih, said assembly comprising:

a support base having an interior edge which bounds and defines an engaging hole; and a connector subassembly received within said defined engaging hole and coupled to said support base, wherein said connector subassembly includes:

(i) an electrically insulating base member sized and configured to be accepted within said engaging hole of said support base; and (ii) a pair of electrical connectors spaced apart from one another so as to establish a mounting space therebetween for receiving an elongate electrical component and for supporting the electrical component within said established mounting space in electrical contact therewith;

said electrically insulating base member defining a pair of connector insertion holes which are sized and configured to accept a respective said electrical connector therewithin;

said electrically insulating base member also including pair of opposed projections extending into said connector insertion holes;

each of said electrical connectors integrally including (1) a resilient U-shaped clamp portion formed of an electrically conductive strip for resiliently holding an electrical component and establishing electrical connection therewtih, and (2) a plug-in receptacle portion for receiving a terminal portion of an electrical lead;

said resilient U-shaped clamps each including a base member which defines openings in which respective ones of said projections are received to mount said U-shaped clamps to said electrically insulating base member; and said support base and connector subassembly collectively including resilient coupling means for allowing said insulating base member to be inserted into said defined engaging hole to achieve a coupled position with respect to said support base, and upon reaching said coupled position, for coupling said insulating base member to said support base.

4. A connector assembly as in claim 3, wherein said resilient coupling means includes:

a number of locking tabs and flanges in paired relationship extending outwardly from said insulating base member, said paired locking tabs and flanges defining therebetween a space for accepting a respective portion of said interior edge, whereby said insulating base is coupled to said support member; and wherein a number of relief slots formed in said support base to in opposition to said locking tabs to allow said support base to resiliently respond in the vicinity of said relief slots to said insulating base member being inserted into said defined engaging hole.

* * * * *